US011276931B2

(12) United States Patent
Vollmer et al.

(10) Patent No.: US 11,276,931 B2
(45) Date of Patent: Mar. 15, 2022

(54) ANTENNA DEVICE AND ANTENNA ARRAY

(71) Applicant: Telefonakiebolaget LM Ericsson (publ), Stockholm (SE)

(72) Inventors: Andreas Vollmer, Rosenheim (DE); Maximilian Göttl, Frasdorf (DE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 0 days.

(21) Appl. No.: 16/486,813

(22) PCT Filed: Feb. 6, 2018

(86) PCT No.: PCT/EP2018/052886
§ 371 (c)(1),
(2) Date: Aug. 16, 2019

(87) PCT Pub. No.: WO2018/149689
PCT Pub. Date: Aug. 23, 2018

(65) Prior Publication Data

US 2020/0227827 A1 Jul. 16, 2020

(30) Foreign Application Priority Data

Feb. 16, 2017 (DE) ..... 10 2017 103 161.8

(51) Int. Cl.
*H01Q 5/28* (2015.01)
*H01Q 1/24* (2006.01)
(Continued)

(52) U.S. Cl.
CPC ..... *H01Q 5/28* (2015.01); *H01Q 1/246* (2013.01); *H01Q 1/38* (2013.01); *H01Q 19/06* (2013.01); *H01Q 21/061* (2013.01)

(58) Field of Classification Search
CPC ..... H01Q 1/38; H01Q 9/0407; H01Q 1/362; H01Q 15/006; H01Q 15/0086;
(Continued)

(56) References Cited

U.S. PATENT DOCUMENTS 6,008,771 A 12/1999 Tanaka et al.
6,188,360 B1 2/2001 Kato et al.
(Continued)

FOREIGN PATENT DOCUMENTS

CN 2645253 Y 9/2004
CN 102110886 A 6/2011
(Continued)

OTHER PUBLICATIONS

Author: Petosa, Title: Recent Advances In Dielectric-Resonator Antenna Technology; pp. 1-14, Date: Jun. 1, 1998; Year: 1998 (Year: 1998).*
(Continued)

*Primary Examiner* — Wei (Victor) Y Chan
(74) *Attorney, Agent, or Firm* — Coats & Bennett, PLLC

(57) ABSTRACT

The invention relates to an antenna device having a printed circuit board and at least one antenna radiator which is arranged on the printed circuit board and can be excited by the printed circuit board or a coupling window arranged thereupon, which radiator is designed in such a manner that it comprises at least two polarisations, which are preferably orthogonal to each other, and at least two resonance frequency ranges which are continuous or different to one another and at an interval from one another, wherein the antenna radiator comprises: at least one first dielectric body mounted on the printed circuit board and designed as a resonator, having a first relative permittivity, at least one second dielectric body designed as, having a second relative permittivity, wherein the first relative permittivity is greater
(Continued)

Figure 1A:
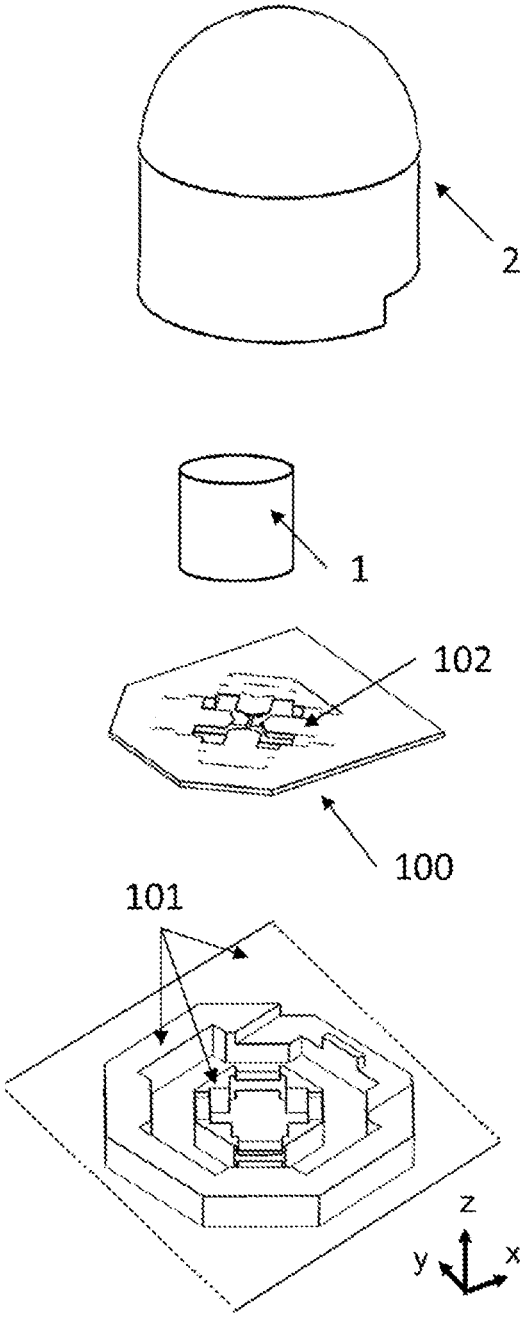

than the second relative permittivity and wherein the second dielectric body is formed in such a manner that it is arranged over the at least one first dielectric body in such a manner that it bundles or scatters the electrical field in a plane orthogonal to the main beam direction at least in one of the resonance frequency ranges. The invention also relates to an antenna array.

23 Claims, 15 Drawing Sheets

(51) Int. Cl.
*H01Q 1/38* (2006.01)
*H01Q 19/06* (2006.01)
*H01Q 21/06* (2006.01)

(58) Field of Classification Search
CPC ..... H01Q 21/0025; H01Q 5/307; H01Q 7/00; H01Q 9/16; H01Q 15/0046; H01Q 9/0442; H01Q 21/24; H01Q 1/243; H01Q 9/0485; H01Q 19/10; H01Q 1/36; H01Q 21/28; H01Q 1/246; H01Q 13/085
See application file for complete search history.

(56) References Cited

U.S. PATENT DOCUMENTS

| | | | | |
|---|---|---|---|---|
| 6,198,450 | B1 * | 3/2001 | Adachi | H01Q 9/0485 343/753 |
| 7,667,666 | B2 | 2/2010 | Chang et al. | |
| 8,988,297 | B2 | 3/2015 | Leung et al. | |
| 2001/0043158 | A1 | 11/2001 | Adachi et al. | |
| 2009/0102739 | A1 * | 4/2009 | Chang | H01Q 1/2291 343/846 |

FOREIGN PATENT DOCUMENTS

| | | | |
|---|---|---|---|
| CN | 104953281 | A | 9/2015 |
| DE | 19600516 | A1 | 7/1996 |
| EP | 0801436 | A2 | 10/1997 |
| EP | 3801436 | A2 | 10/1997 |
| TW | 200845489 | A | 11/2008 |

OTHER PUBLICATIONS

Author: Murata, Title: Murata Manufacturing COJP [DE19600516A1] Date: Oct. 15, 1997 pp. 1-20 (Translation): Year: 1997 (Year: 1997).*
Author: Murata, Title: Murata Manufacturing COJP [DE19600516A1 ] Date: Oct. 15, 1997 pp. 1-20: Year: 1997 (Year: 1997).*
Author:Roscoe, Dave, Title: Communication Research Centre Ottawa [EP0801436A2], Date: Aug. 4, 1994; Year: 1994 (Year: 1994).*
International Search Report and Written Opinion for Application No. PCT/EP2018/52886, dated Apr. 18, 2018, 4 pages.
Petosa et al., "Dielectric Resonator Antennas: A Historical Review and the Current State of the Art," IEEE Antennas and Propagation Magazine, vol. 52, No. 5, Oct. 2010, pp. 91-116.
Kumari et al., "Circularly Polarized Dielectric Resonator Antennas: Design and Developments," Wireless Personal Communications, Springer, Dordrecht, NL, vol. 86, No. 2, Jul. 28, 2015, pp. 851-886.
Petosa et al., "Recent Advances in Dielectric-Resonator Antenna Technology," in IEEE Antennas and Propagation Magazine, vol. 40, No. 3, Jun. 1998, pp. 35-48.
Fayad, H., et al., Experimental investigation on new steerable dielectric resonator antenna, Electronics Letters, Sep. 13, 2007, vol. 43, No. 19.
Mukherjee, Biswajeet, et al., A Novel Hemispherical Dielectric Resonator Antenna with rectangular slot and Defected Ground Structure for low cross polar and wideband applications, 2013 Annual IEEE India Conference (INDICON).
Petosa, Aldo, et al., Dielectric Resonator Antennas: A Historical Review and the Current State of the Art, Communications Research Centre Canada, IEEE Antennas and Propagation Magazine, vol. 52, No. 5, Oct. 2010, pp. 91-116, ISSN 1045-9243/2010.

* cited by examiner

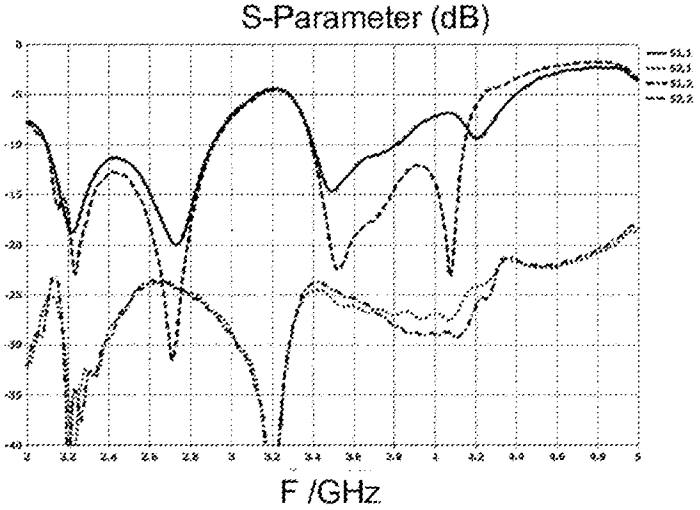
Fig. 5a
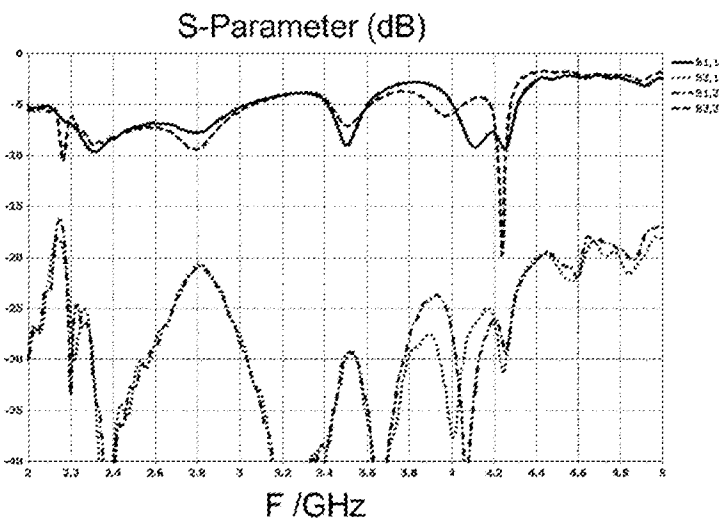
Fig. 4a
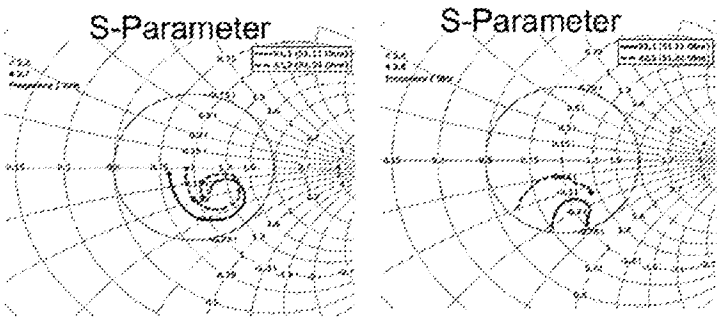
Fig. 5b
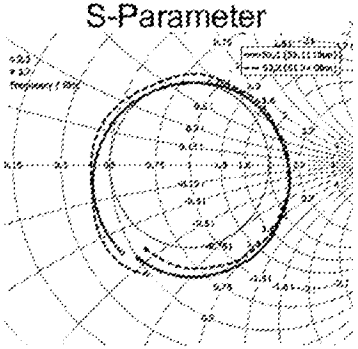
Fig. 5c
Fig. 4b
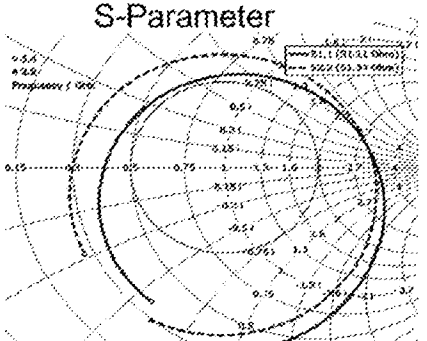
Fig. 4c

ANTENNA DEVICE AND ANTENNA ARRAY

The invention relates to an antenna device pursuant to the generic term of patent claim 1, and a corresponding antenna array.

Ever newer radio technologies are being developed for mobile radio. As a result, the technical limits—in particular the capacity limits—of passive antenna systems are being reached ever more rapidly. One solution is to equip an array of several individual radiators with several transmission and receiver amplifiers. These would then realize controllable antennas for beam-steering and beam-forming, or also for MIMI mode. The use of several transmission and receiver modules in MIMO mode is advantageous primarily in situations when there is no direct line of sight between the transmitter and receiver. For several years, the use of active antennas has been seen as a solution for many problems in mobile radio as it relates to capacity, transmission, increasing the data rate, etc. To date, active antenna arrays with several transceivers have been unable to gain a substantial foothold for the following reasons. The many active components present a major challenge as it relates to costs and reliability. Moreover, the overall efficiency of active antenna arrays is very poor due to the high insertion losses of the duplex filters of up to 3 dB and the low efficiency of the amplifiers in the low power range of 0.2 . . . 2 W. In addition, there are currently no known solutions for multi-band operation without the extensive use of filters. Separate active antenna arrays would then have to be realized to reduce the use of filters, e.g. for every transmission and receiver band. This is frequently due to the inability to physically segregate the radiators for the various bands, also due to space constraints.

The higher network technology generations, for example the MIMO (multiple in-multiple out) technology introduced for LTE technology is now creating new problems with respect to HF properties since ever higher data rates, etc. need to be transmitted. MIMO uses several antennas or antenna modules of the same design. The transmission is based on the dimensions frequency, time, and space. On the one hand, by sending and receiving a signal with several, preferably orthogonally polarized antennas, the transmitter and receiver is given a so-called signal diversity, that is to say additional information about the transmitted signal, thus achieving higher system performance. On the other hand, switching together and tuning several antennas gives the transmitter and receiver an improved signal-to-noise ratio, thus also achieving higher system performance. This technology can significantly increase the quality and data rate of a wireless connection. MIMO is already in use for the 4G standard and will in the future be elevated to a next level, called Massive MIMO.

A problem requiring a solution is provisioning compact broadband group antennas with high directivity. Sub-optimal solutions for this are already known, e.g. dielectric resonator antennas. These are typically based on radiators on which a dielectric body with high relative permittivity is excited. They permit very compact group antennas due to their high integration density facilitated by radiator miniaturization. This is particularly advantageous on antennas with several radiator systems and/or bands, e.g. on active antennas and/or multiband/multiport antennas. High transmission rates are also possible due to low individual radiator spacing, in particular on beam-forming and/or MIMO applications. On the other hand, due to the high relative permittivity of the dielectric resonator and/or radiator miniaturization and/or the resulting low radiator volume only, they only achieve low directivity and bandwidths, in particular in dual-pol dual-band mode.

Resonator antennas for dual polarized antennas are e.g. known from the publication "IEEE: Dual-linearly polarized dielectric resonator antenna array for L and S band applications" by Ayaskanta Panigrahi; S. K. Behera (in Microwave, Optical and Communication Engineering (ICMOCE), 2015 International Conference on 18-20 Dec. 2015, pages 13-16, DOI: 10.1109/ICMOCE.2015.7489679). It is also known that use of a dielectric lens can result in improved directivity. Such a lens is e.g. shown in the antenna device disclosed under the European Patent Number EP 0871239 B1, which discloses a dielectric transmission line and a resonator coupled thereto.

It is further known that dielectric resonator antennas in an interleaved arrangement can reduce the use of filters, as disclosed under the European Patent Number EP 1908147 B1.

It is also known that dielectric bodies can be used as dual polarized rod radiators and can have the properties of a radiator based on travelling waves, which is disclosed in the to-date not yet published German Patent Filing DE 10 2016 002 588.3, and in the publication "Wideband Dual-Circularity-Polarized Dielectric Rod Antenna for Applications in V-band frequencies" by M. W. Rousstia et al. and for the ICT Proceedings on Nov. 27-28, 2013.

But to date, no solution is known that realizes high directivity, high bandwidths, and a compact arrangement in multiband mode.

The task of this invention is therefore to provide an antenna device and a corresponding array that provides improved antenna diagrams and bandwidths in dual-pol dual-band mode in a compact arrangement. The invention can be advantageously used in mobile radio applications, and here, in particular, in a mobile radio base station antenna in the frequency range 0.3 GHz-15 GHz, and here, in particular, in the frequency range 0.5 GHz-6 GHz.

This task is solved according to the invention by attributes in the independent patent claims. Advantageous embodiments are the scope of the dependent claims.

The proposed antenna is a compact antenna, hereinafter called antenna device, with orthogonal polarization and several resonance frequency ranges. Said antenna device has at least two dielectric bodies. The first dielectric body predominantly generates the resonance frequency ranges and the second dielectric body increases the bandwidth of the resonance frequency ranges or matches the directivity (far field diagrams) of the lower resonance frequency range to the upper resonance frequency range.

Depending on the design of the second dielectric body, the antenna device can then have properties of a dielectric resonator antenna and properties of a dielectric rod antenna. In particular, the design of the dielectric body can increase the resonance frequency ranges to such an extent that they overlap. The antenna device typically has resonance frequency ranges distant from each other when predominantly designed as a dielectric resonator antenna and overlapping resonance frequency ranges when predominantly designed as a dielectric rod radiator.

Depending on the application—that is to say beam-forming and/or beam-steering—a high 3 dB half power beam width can be more advantageous than high directivity. The half power beam width (HPBW or 3 dB opening angle) is defined as the angle range at which the directivity of the antenna drops to half the maximum value (factor 0.5~3 dB).

The very high difference in the relative permittivity between the two dielectric bodies is characteristic.

The proposed antenna device has a printed circuit board and at least one antenna radiator arranged on the printed circuit board and excitable by the printed circuit board or by a coupling window arranged thereupon, which the radiator is designed in such a manner that it comprises at least two polarizations, which are preferably orthogonal to each other, and at least two resonance frequency ranges which are continuous or different to one another and at an interval from one another, wherein the antenna radiator comprises: at least one first dielectric body mounted on the printed circuit board and designed as a resonator, having a first relative permittivity, at least one second dielectric body designed as [ . . . ], having a second relative permittivity, wherein the first relative permittivity is greater than the second relative permittivity and wherein the second dielectric body is formed in such a manner that it is arranged over the at least one fir dielectric body in such a manner that it bundles or scatters the electric field in a plane orthogonal to the main beam direction at least in one of the resonance frequency ranges.

Further attributes and advantages of the invention are disclosed in the following specification of exemplary embodiments of the invention, based on figures in the drawings, which show details according to the invention, and from the claims. The individual attributes can each be embodied individually by themselves or in several arbitrary combinations for a variant of the invention.

Preferred embodiments of the invention are discussed in detail based on the following attached drawings.

Figure 1B:
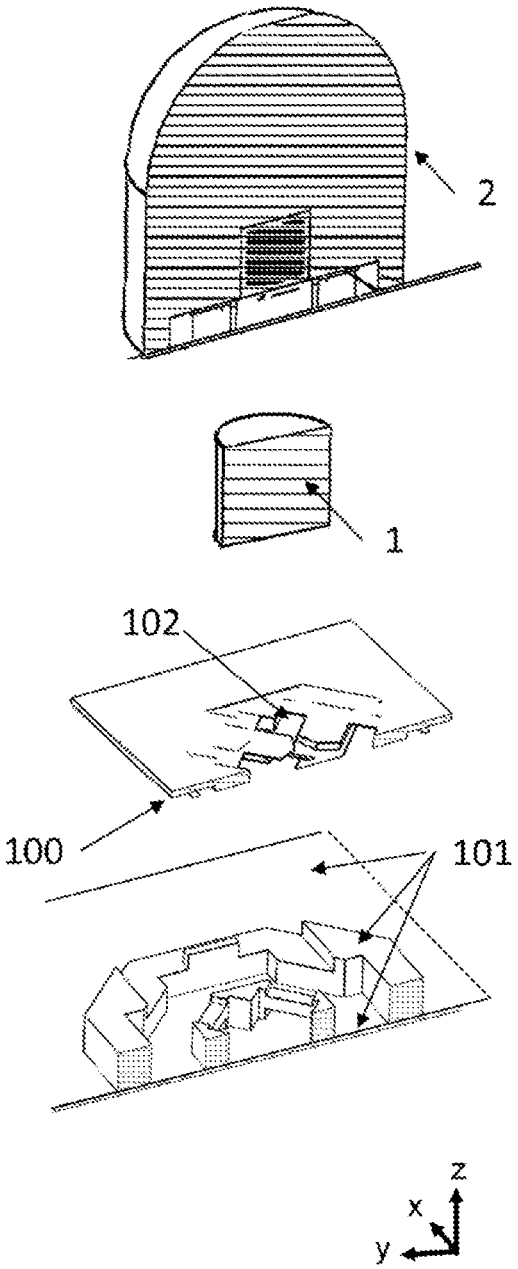

FIGS. 1*a* and 1*b* show an exploded view of, and a cross-section through, the antenna device according to an embodiment of the present invention.

Figure 2A:
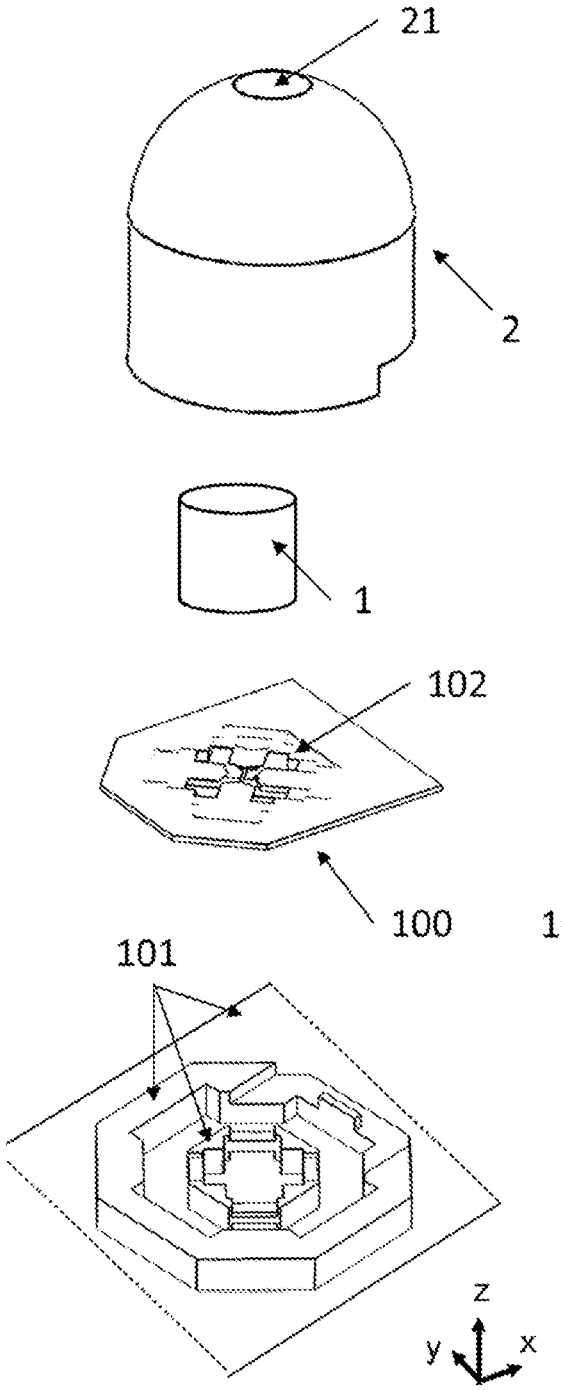
Figure 2B:
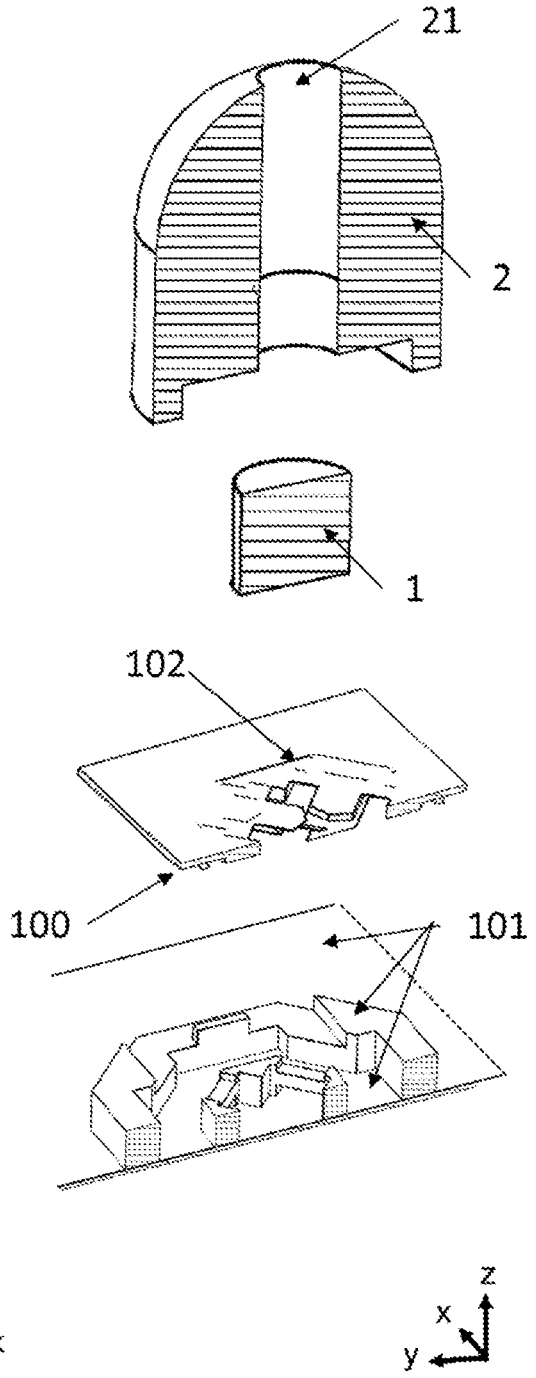

FIGS. 2*a* and 2*b* show an exploded view of, and a cross-section through, the antenna device according to a further embodiment of the present invention.

Figure 3A:
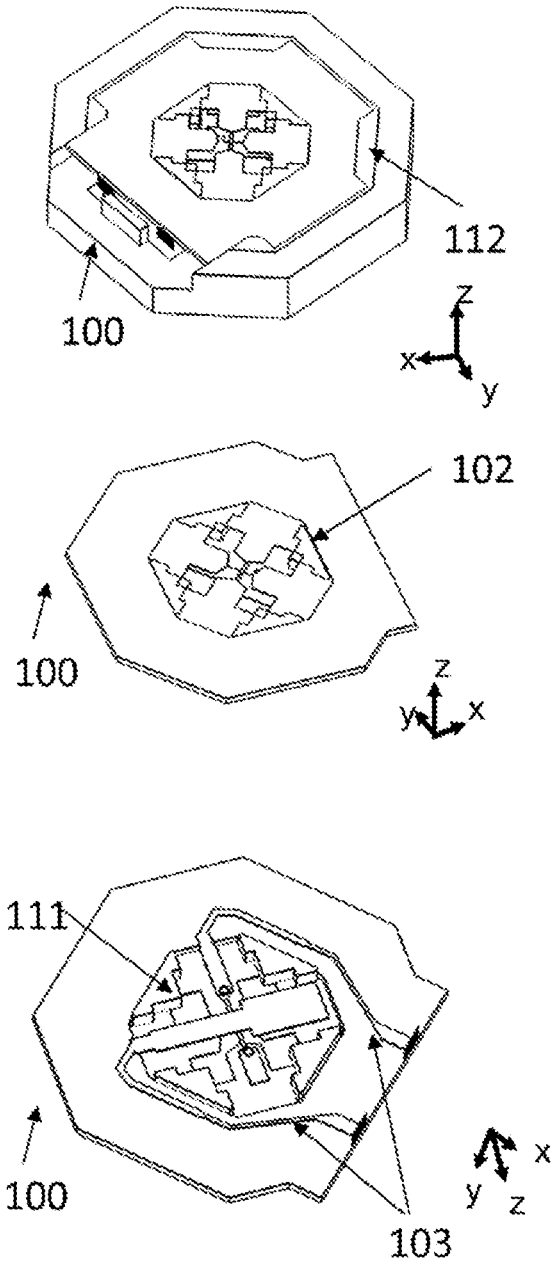
Figure 3B:
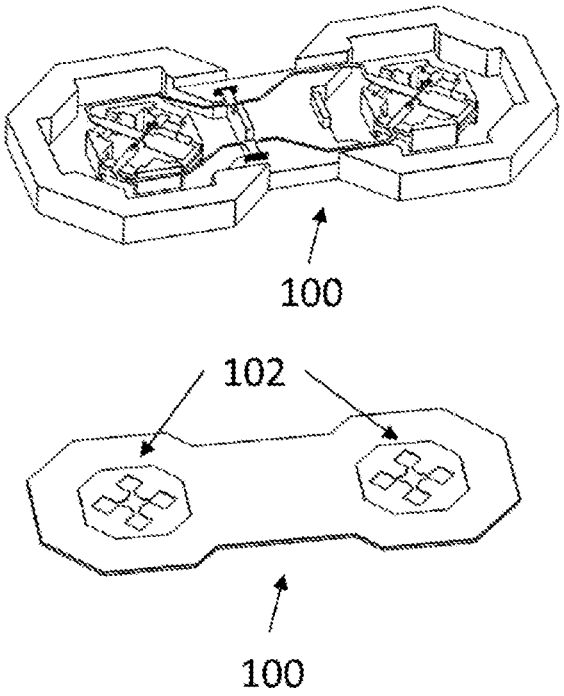
Figure 6A:
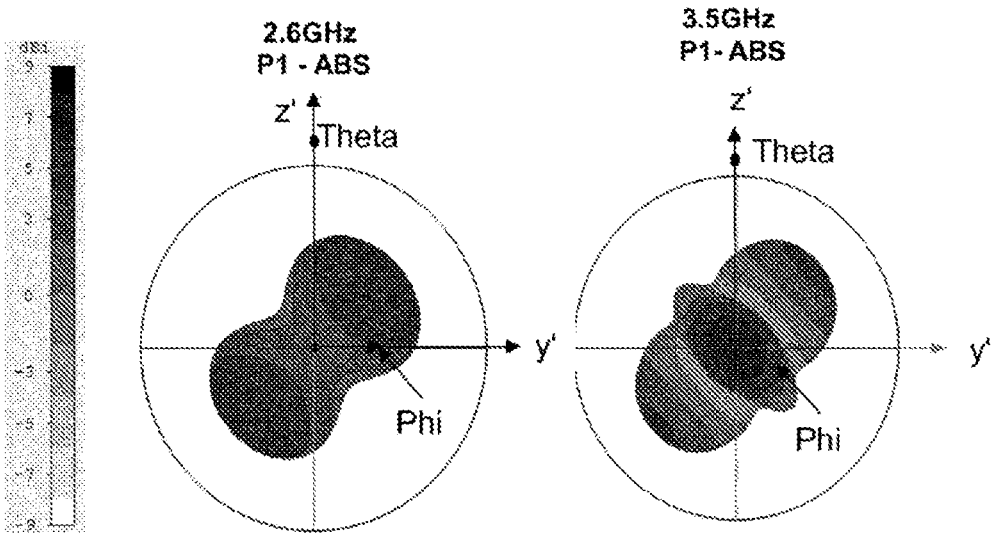
Figure 6B:
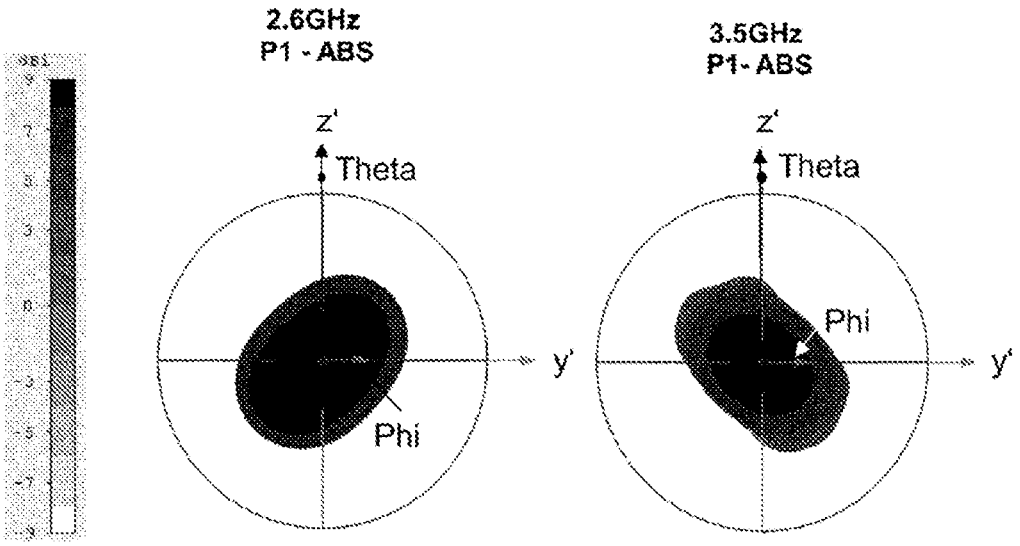

FIGS. 3*a* to 3*b* show a representation of the printed circuit board for an individual antenna radiator and for two switched together antenna radiators according to an embodiment of the present invention.

FIGS. 4 to 13 show electrical values for an embodiment with and without second dielectric body.

Figure 14A:
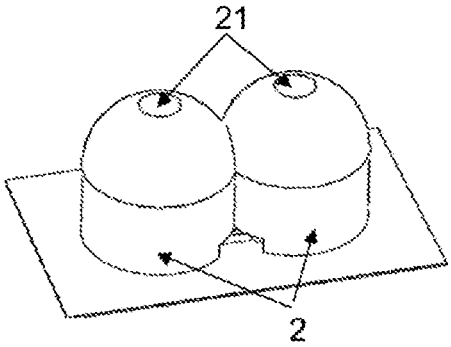
Figure 14B:
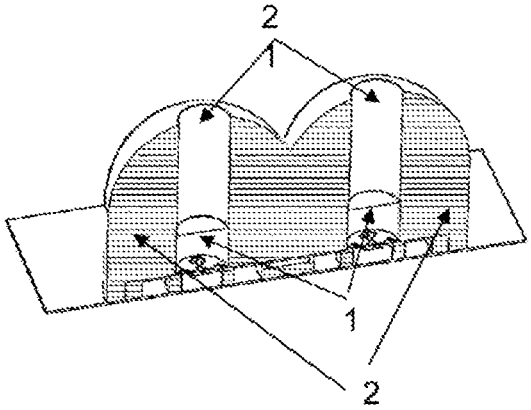

FIGS. 14*a* to 14*b* show a view of, and a cross-section through, an antenna array according to an embodiment of the present invention.

Figure 15A:
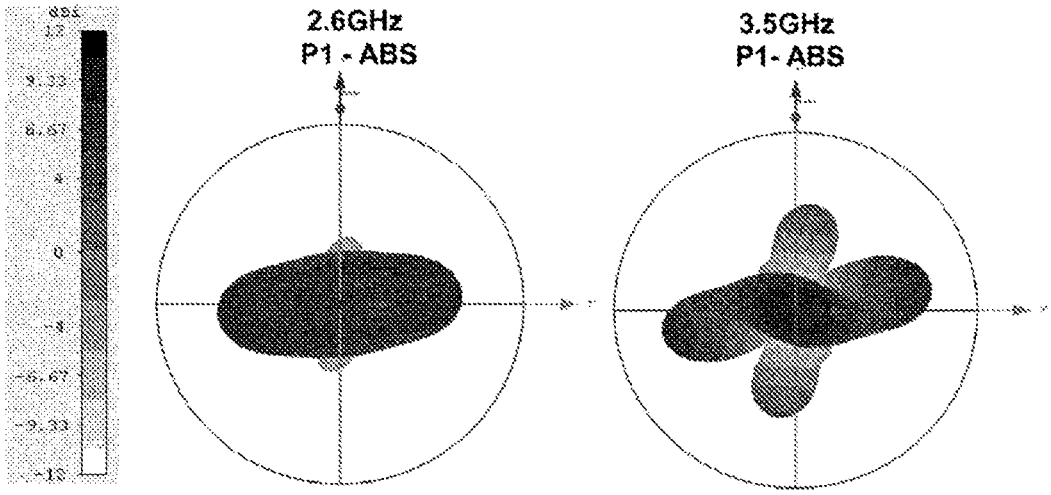
Figure 15B:
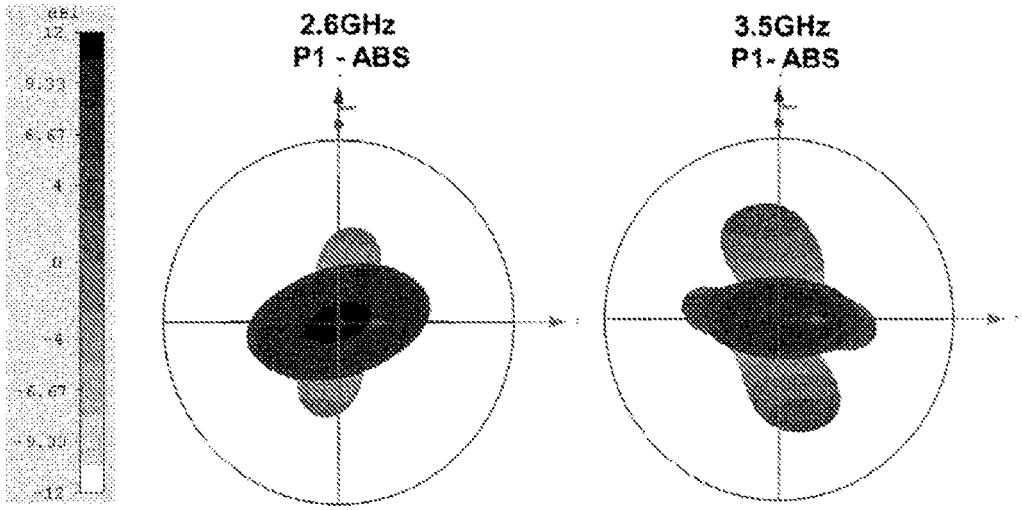

FIGS. 15*a* to 15*b* show antenna diagrams for an embodiment with and without second dielectric body.

Figure 16A:
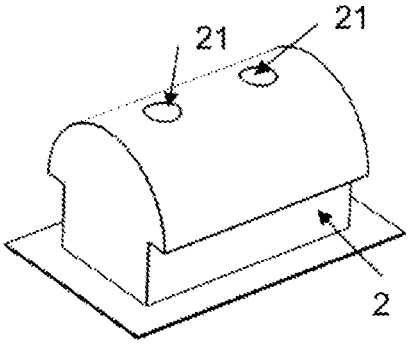
Figure 16B:
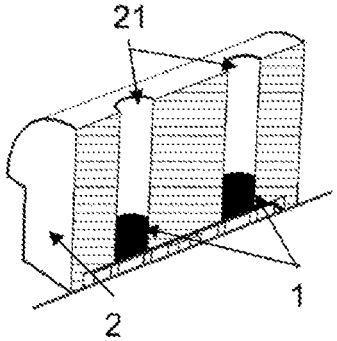
Figure 16C:
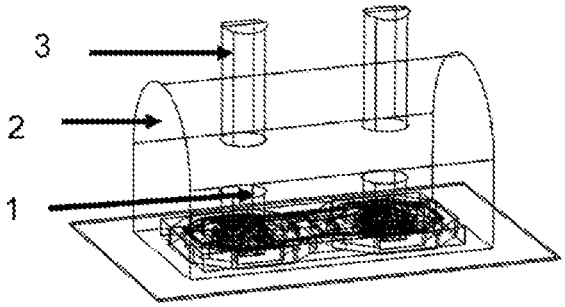

FIGS. 16*a* to 16*c* show a view of, and a cross-section through, an antenna array according to a further embodiment of the present invention.

FIGS. 17*a* to 17*e* show the dimensional properties of an antenna device according to various embodiments of the present invention.

Figure 17A:
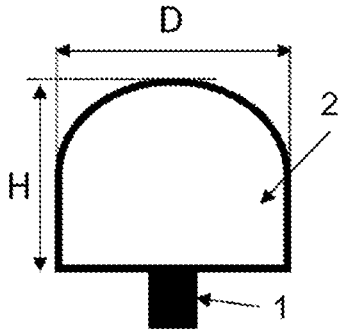
Figure 17B:
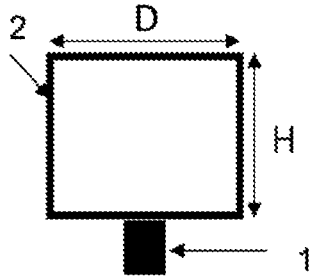
Figure 17C:
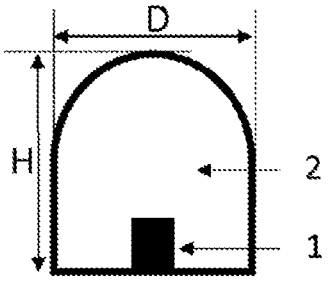
Figure 17D:
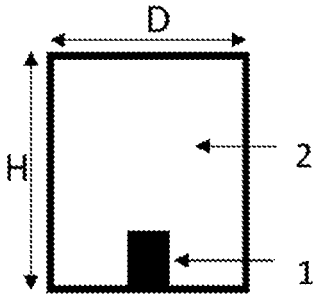
Figure 17E:
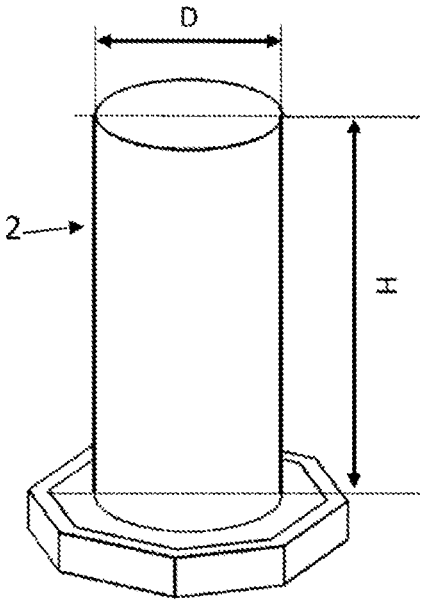
Figure 17F:
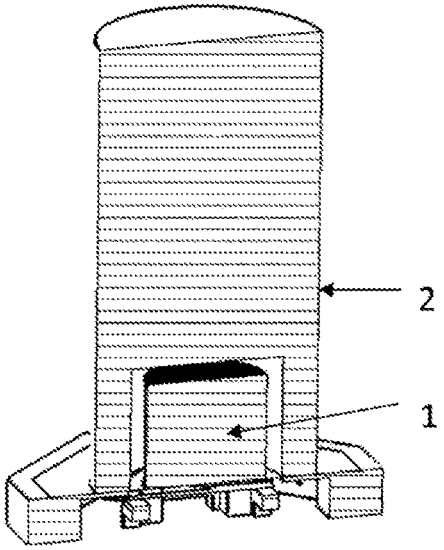

FIG. 17*f* shows a vertical cross-section of a rod radiator according an embodiment of the present invention.

FIGS. 18*a* to 18*d* show a cross-section through differently-shaped second dielectric bodies having a mechanical dead stop according to a further embodiment of the present invention.

Figure 19A:
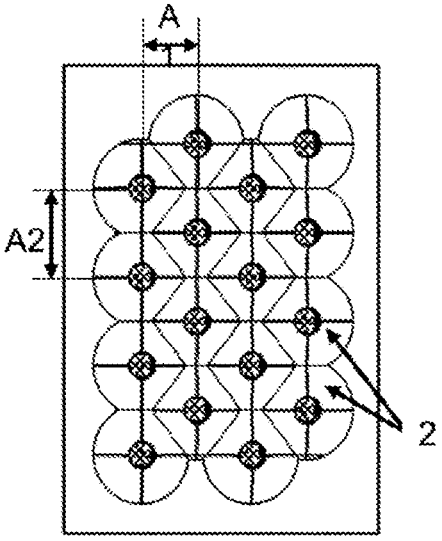
Figure 19B:
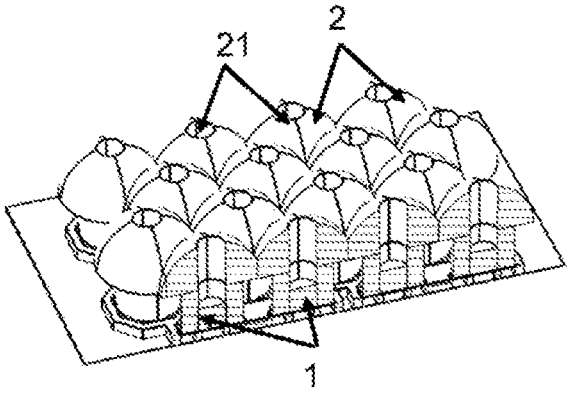
Figure 20A:
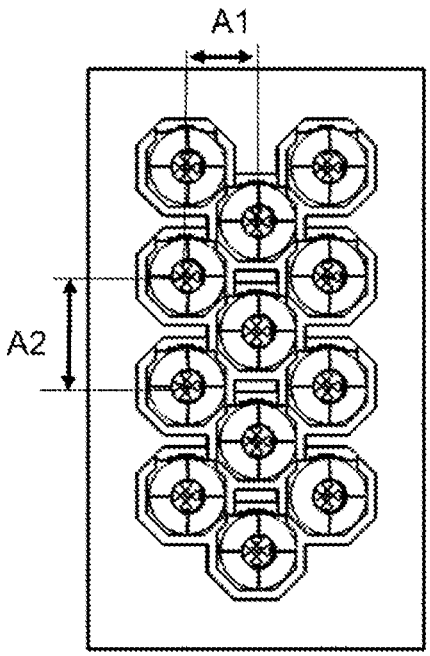
Figure 20B:
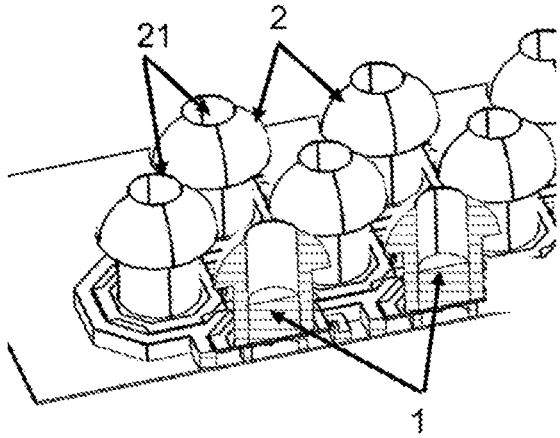

FIGS. 19 to 20 each show a view of, and a cross-section through, an antenna array according to various embodiments of the present invention.

Figure 21:
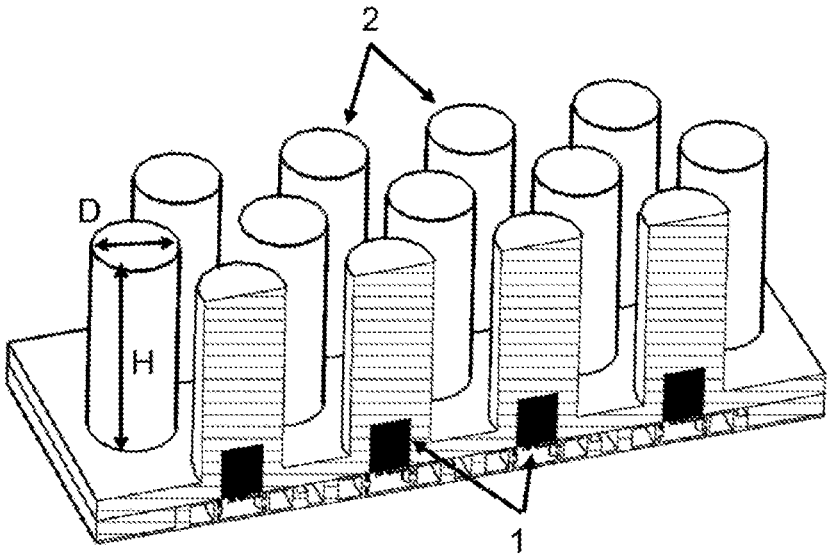

FIG. 21 shows a cross-section through an antenna array according to a further embodiment of the present invention.

Figure 22A:
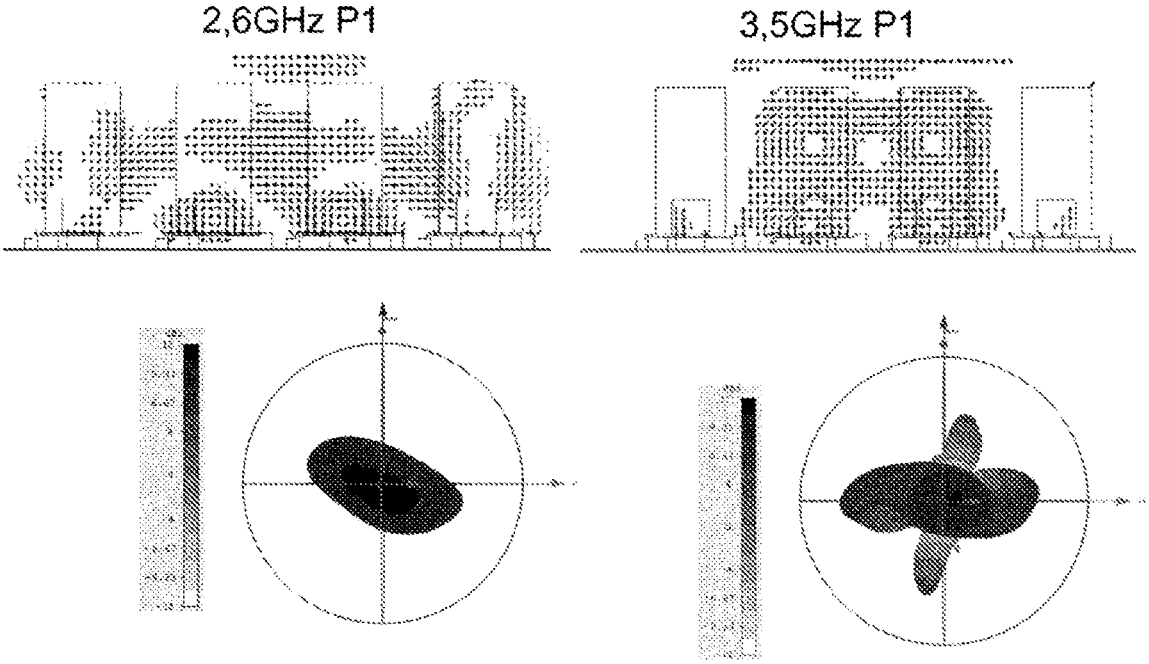
Figure 22B:
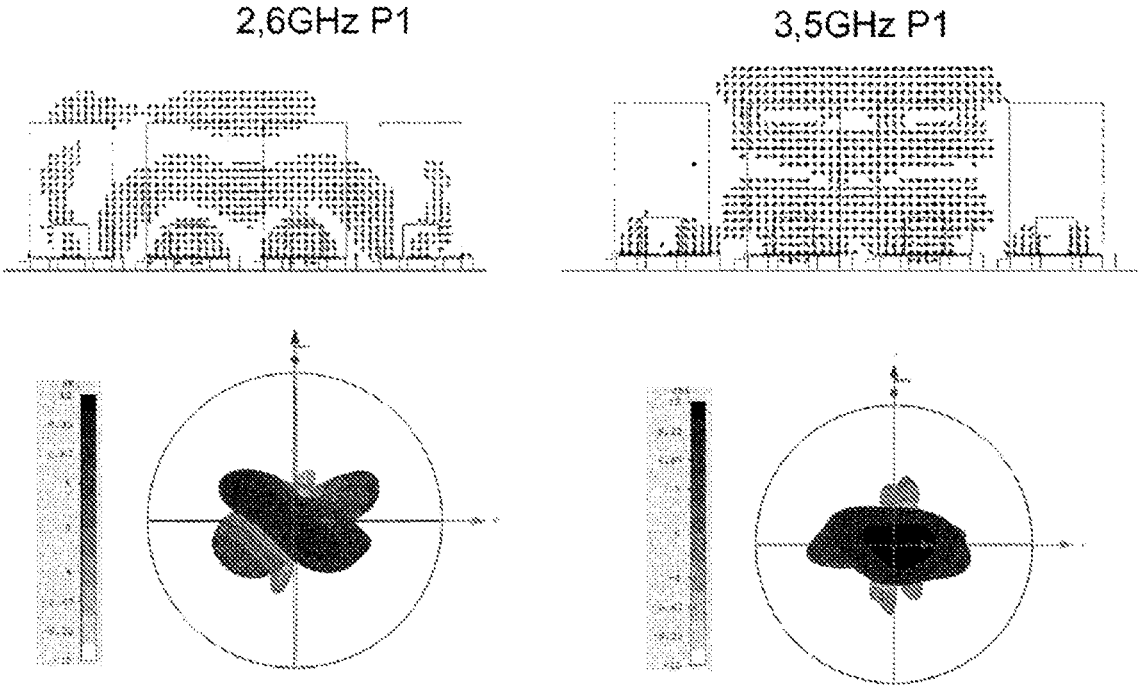

FIGS. 22*a* to 22*b* show antenna diagrams for various thicknesses of the rod radiators of the antenna array shown in FIG. 21

In the following descriptions of the figures, the same elements and/or functions are assigned the same reference symbols.

An antenna device 10 according to the invention has at least two polarizations, preferably orthogonal polarizations, and at least two resonance frequencies that are continuous, or two resonance frequencies that are different and distant from one another, e.g. at least not continuous. The resonance frequency range of a radiator is in each case preferably defined as a continuous range with a return loss of better than 6 dB and preferably better than 10 dB, and further preferably better than 14 dB. The wavelength details λ typically refer to the center frequency of the lowest resonance frequency range of the radiators.

FIGS. 1*a*, 1*b*, 2*a*, and 2*b* each show an exploded view of the antenna device 10 and a cross-section through the antenna device 10 of two different embodiments of the inventions. These show a first part arranged on a printed circuit board 100 arranged on a carrier 101 that is not necessarily associated with the antenna device, and a second part arranged on the first part. A first dielectric body 1 is arranged on the second part of the printed circuit board 100. Above said first dielectric body 1, a second dielectric body 2 is arranged that acts as an integrated lens or as a radiator with travelling waves and/or as a dielectric rod radiator suited to bundle beams and/or to decouple radiators and/or to expand resonance frequencies. Travelling wave antennas (TWA) refers to antennas that use a travelling wave on a guide structure as the main radiation mechanism. Surface wave antennas (SWA), which also include dielectric rod radiators, represent a sub-category of this antenna group.

As shown in FIGS. 17*c* and 17*d*, the first dielectric body 1 is either incorporated, that is to say integrated into, the second dielectric body 1, is in direct contact with the latter, as shown in FIG. 17*a*, or—as shown in FIG. 17*b* or 17*f* (described in detail later)—is electromagnetically coupled with the latter by an air slot, in particular with dimensions less than 0.15 of the wave length in the direction of the wave propagation, as shown in Figure [ . . . ].

As can be seen in FIGS. 2*a* and/or 2*b*, the second dielectric body 2 can also have an air slot and/or a material recess 21. The individual components and their operating principles are described in detail below.

Printed Circuit Board

The structure of the printed circuit board 100 is discussed as follows based on FIGS. 3*a* to 3*b*. As shown in FIGS. 3*a* to 3*b*, the printed circuit board 100 is preferable a multilayer printed circuit board but can also have a different design. The aforementioned first and second parts serve to excite a first dielectric body 1 designed as a resonator and arranged on the printed circuit board 100, specifically its second part. In FIG. 3*a*, top graphic, the first and the second part of the printed circuit board 100 are already connected to each other. Here, it can be seen that a cross-shaped area is recessed in the center that features circuit board conductors and/or microstrip feeds, so that the first dielectric body 1 can be symmetrically excited here. FIG. 3*a*, center graphic, is a view from above of the shown printed circuit board 100, wherein the (carrier) substrate is not shown. FIG. 3*a*, bottom graphic, is a view from below of the shown printed circuit board 100, wherein Via-areas 111 can be seen here, that is to say areas that contain through-contacts to other layers of the printed circuit board 100. Further through-contacts can also be used, in particular at the end and/or in the vicinity of the open microstrip feeds, in order to improve the adjustment of the antenna and/or the coupling of the microstrip feed with the coupling window 102, e.g. as shown in FIGS. 1*a* and 2*a* and preferably designed as two slots orthogonal to each other.

FIG. 3*b* shows a printed circuit board 100 designed to realize a connected circuit of two individual radiators (antenna radiator 10) implemented in microstrip feed technology 103. This is intended to achieve a far field bundling in the plane of the connected circuit.

As can also be seen in e.g. in FIGS. 1*a* and 2*a*, the printed circuit board 100 shown in FIG. 3*a* (and also in FIG. 3*b*) comprises an optional slot 112 between the printed circuit board metallization and the metallic printed circuit board substrate. The slot can be selected such that it excites the first dielectric body 1 or the second dielectric body 2 in a desired resonance frequency range and/or co-radiates, and therefore contributes to the electrical properties of the antenna radiator 10. The substrate 101 (see e.g. FIGS. 1*a* and 1*b*) of the printed circuit board 100 is preferably made of metal but can also be made of a dielectric. In an optional embodiment, said substrate 101 can be used to fix the dielectric bodies 1 and/or 2, e.g. by respectively fastening or bonding these to the substrate 101 with screws or adhesive, or joining these to the substrate 101 by other means and methods.

Wave guides and body excitations other than a wave guide implemented in microstrip feed technology and a coupling window 102 e.g. arranged as a slot are also conceivable. In particular, e.g. wave guides of type CPW (Coplanar Waveguide), CSL (Coplanar Stripline), SIW (Substrate Integrated Waveguide) are conceivable, each with or without coupling window 102 on the substrate top side. A more cost-effective dual layer printed circuit board is also conceivable in lieu of a multilayer printed circuit board 100. Feed crossings can in this case be realized e.g. with an airbridge.

First Dielectric Body

The aforementioned first dielectric body 1 is preferably arranged on the second part of printed circuit board 100 in a manner such that the excitation of the first dielectric body 1 by printed circuit board 100 occurs symmetrically relative to the center-point of its cross-section. This applies to all usable shapes, wherein simple shapes and/or cross-sections such as cylinders, cuboids, etc. are preferred for cost reasons. The dielectric body 1 is excited symmetrically by the printed circuit board 100 and in particular by a coupling window 102 preferably arranged as a slot. Advantageously, the dielectric body 1 covers at least 75%, further preferably at least 90%, of the surface of the coupling window, as the excitation is the better the greater the coverage.

The first dielectric body 1 further preferably has a relative permittivity of $\varepsilon r \geq$, further preferably of $\varepsilon r \geq 15$. The first dielectric body 1 is in this case not limited to being formed as a single piece. It can instead be formed from several parts that in total have the correspondingly required relative permittivity. In particular, this means that a material mixture is also possible. For example, the first dielectric body 1 can be made of glass, glass-ceramics, or another suitable material, or a suitable material mixture that has the required relative permittivity.

Second Dielectric Body

The aforementioned second dielectric body 2 is arranged over the first dielectric body 1 as an integrated lens or rod radiator or dielectric, e.g. it incorporates the first dielectric body 1 into itself and/or surrounds it completely (excluding the part that directly contacts the printed circuit board 100) or is directly connected thereto, e.g. in contact with it. The second dielectric body 2 preferably has a relative permittivity $2 \geq \varepsilon r2 \leq 5$, further preferably $2 \geq \varepsilon r2 \leq 3.5$. The second dielectric body 2 is in this case also not limited to being formed as a single piece. It can instead be formed from several parts that in total have the correspondingly required relative permittivity. In particular, this means that a material mixture is also possible. For example, the second dielectric body 2 can be made of glass, glass-ceramics, a mixture thereof, or another suitable material, or a suitable material mixture that has the required relative permittivity. The bandwidth is adjusted by selecting the material, more precisely, by selecting the suitable $\varepsilon r$. A filter effect can then at the same time also be realized between the resonance frequency ranges. As a result, normally required downstream filters can be omitted or can be substituted by less selective filters. This not only reduces costs, but also reduces the space requirements.

The following variants are for example conceivable to achieve an effective permittivity, that is to say a total permittivity of both dielectric bodies 1 and 2 of $\varepsilon r=20$, e.g. that $\varepsilon r=|\varepsilon r1-\varepsilon r2|=20$: one of the bodies has a relative permittivity of $\varepsilon r=10$, the other body has a relative permittivity of $\varepsilon r=30$, additionally due to air holes, material recesses, different material densities, etc. Both dielectric bodies 1 and 2 can also be consolidated into a single body, e.g. can even consist of the same material, wherein the relative permittivity is in this case varied by an air inclusion of varying thickness. A combination of a material with an injection-molded granulate is also conceivable to vary the relative permittivity. Several dielectric bodies with varying $\varepsilon r$ can also be layered, like an onion structure so to speak, to achieve the required relative permittivity.

Generally, the embodiment of the second dielectric body 2 with regard to shape and material composition is preferably such that with the assistance of the second dielectric body 2, at least one resonance frequency range experiences an enlargement and/or increase of directivity and/or an increase in the half power beam width, or at least two resonance frequency ranges experience an enlargement and/or increase and/or alignment of directivity and/or antenna diagrams, and/or the lowest resonance frequency range in the main radiation direction experiences a higher increase of directivity and/or the antenna gain than the upper resonance frequency range(s), and/or antenna diagram of the lowest resonance frequency range exhibits a higher similarity with the antenna diagram of the upper resonance frequency range(s). These prerequisites can be realized with a suitable combination of the material and the shape of the second dielectric body 2.

Figure 18A:
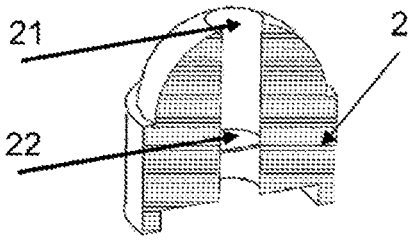
Figure 18B:
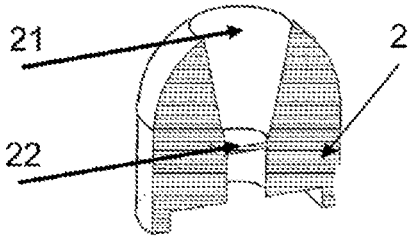
Figure 18C:
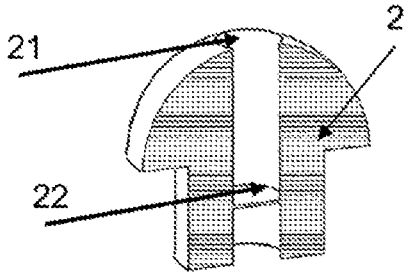
Figure 18D:
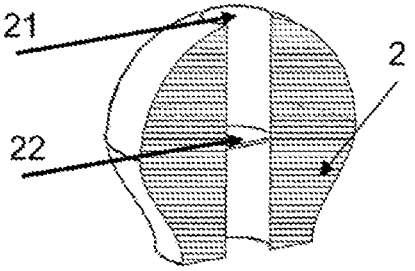

Alternative shapes of the second dielectric body 2 are shown as examples in FIGS. 18*a* to 18*d*, wherein these also show an air slot and/or a material recess 21, the shape of which is selected according to the application, e.g. with constant expansion or not constant expansion vertically to the beam plane, as for example shown in FIG. 18*b*.

As already mentioned above, the second dielectric body 2 can also be formed without an air slot and/or a material recess 21 since two similar antenna diagrams in two different resonance frequency ranges can also be achieved without an air slot and/or a material recess 21. However, the air slot and/or the material recess 21, without limitation, have the advantages that the antenna diagrams of the two resonance frequency ranges can be realized with a simple shape of the second dielectric body 2, and the first dielectric body 1 can be inserted or integrated more easily.

Moreover, an optional third dielectric body 3 can be additionally used to modify the antenna diagram, as shown in FIG. 16. The relative permittivity of the third dielectric body 3 is then selected such that εr3=εr2±5. The shape and length and/or the volume of the third dielectric body 3, without limitation, depend on its relative permittivity and the application.

The (at least) one air slot and/or the (at least) one material recess 21 also slightly modify the antenna diagram, wherein the lowest resonance frequency range is affected less than the upper resonance frequency range(s) with respect to gain in the main beam direction.

FIGS. 18*a* to 18*d* also show a mechanical dead stop 22 within the second dielectric body 2. Its purpose is to fix the first dielectric body 1 therein.

Alternatively, a retainer or fastening mechanism can be integrated in the second dielectric body 2. The mechanical dead stop 22 can be formed as a single piece with the second dielectric body 2 but can also be fastened therein as, e.g. as a separately inserted part.

A partial metallization of at least one body surface or the incorporation of metal objects in at least one of the dielectric bodies 1 or 2 is also conceivable.

The surface of the first dielectric body 1 or the inner side of the second dielectric body 2 can e.g. be metallized to generate a parasitic resonance, thus expanding at least one resonance frequency range or partially blocking a resonance frequency range. The surface of the second dielectric body 2 can e.g. be metallized in order to modify the antenna diagram for certain frequencies and in particular to increase or lower the directivity in certain frequency ranges.

The second dielectric body 2 is for example formed as an integrated lens or the first dielectric body 1 is directly embedded in the second dielectric body 2, as shown in FIGS. 17*a* and 17*c*, said lens bundling at least one resonance frequency range in a plane orthogonal to the main radiating direction. The lens can be similar in its cross-section to a hyper-hemispherical integrated lens or an elliptical integrated lens. It can also in its cross-section be similar to a converging lens or Fresnel lens, or to an index-gradient lens, and in its cross-section have at least two different relative permittivities, wherein the difference is preferably generated by varying material densities and further preferably by material recesses (air).

A second dielectric body 2 with lens curvature can also be used, as shown in FIG. 17*b* or 17*d*, 17*e* or 17*f*, so that e.g. only the rod part is used, or the first dielectric body 1 is directly embedded in the second dielectric body 2, as shown in FIG. 17*f*. Here, there is an air gap between the first dielectric body 1 and the second dielectric body 2, so that these are electromagnetically coupled, as described above. In this case, the second dielectric body so to speak degenerates from a dielectric (integrated) lens into a dielectric rod radiator. It must be noted for this that the thickness D can change over the height H, wherein the maximum thickness D and height H of the second dielectric body 2 have the following relationship to the wave length λ of the center frequency of the lowest resonance frequency range of the antenna and the effective relative permittivity εr2 of the second dielectric body 2:

$$0.5 * \frac{\lambda}{\sqrt{\pi(\varepsilon_{r2}-1)}} \leq H \leq 2.5 * \frac{\lambda}{\sqrt{\pi(\varepsilon_{r2}-1)}} \text{ and/or} \quad (1)$$

$$0.5 * \frac{\lambda}{\sqrt{\pi(\varepsilon_{r2}-1)}} \leq D \leq 2.5 * \frac{\lambda}{\sqrt{\pi(\varepsilon_{r2}-1)}}. \quad (2)$$

The following advantageous relationship exists between the maximum thickness (D) and the height (H): D=(1.0±0.5)×H, if designed as a lens or radiator, and/or D=(0.5±0.25)×H, if designed as a radiator. Compact dimensions of the antenna device can thus be achieved.

The shape of the second dielectric body 2 can also be selected such that hybrid beam-forming is achieved, e.g. preferably two antenna radiators 10 are connected together into a circuit, wherein the resulting vertical bundling is primarily achieved by individual radiators connected together into a circuit, and the resulting horizontal bundling is primarily achieved by at least one second dielectric body 2, wherein the second dielectric body 2 is designed such that it only bundles a plane orthogonal to the main beam direction. For this, it is advantageous when the second dielectric body 2 is shaped such that it incorporates two antenna radiators 10 into itself, see e.g. the exemplary embodiments FIGS. 14*a* and 14*b* or 16*a* to 16*c*. As can be seen in the figures, varying shapes can be selected for the second dielectric body 2, depending on what requirements are specified. If the antenna radiators 10 are not connected together into a circuit and/or coupled, the second dielectric body 2 can also be formed such that several second dielectric bodies 2 are connected to each other, thus achieving simplified assembly and greater packing density, as also shown in FIGS. 19*a*, 19*b*. For low individual radiator spacing, that is to say the spacing between individual antenna radiators of an array, in particular for group antennas with small gap spacing, it can however be advantageous that the two dielectric bodies 2 do not, or barely, make contact, as shown in the examples of the exemplary embodiments in FIGS. 20*a*/20*b* and 21. As shown in the various exemplary embodiments in FIGS. 19*a*/19*b*, 20*a*/20*b*, and 21, several antenna radiators 10 can then be arranged below each other and next to each other, that is to say in rows and columns, preferably at an offset to each other. This facilitates a further increase of the packing density and also better decoupling between the columns. For example, the spacing in horizontal direction, labeled as A1 in FIGS. 19*a* and 20*a*, can be smaller than the spacing in vertical direction, labeled as A2 in FIGS. 19*a* and 20*a*. The spacing A1 and/or A2 between the rows and/or columns is preferably less than or equal to 0.75 wavelengths and further preferably less than or equal to 0.5 wavelengths of the center frequency of the lowest employed resonance frequency range.

FIG. 19*a* shows an embodiment for resonance frequency ranges from 2.3 GHz to 2.7 GHz and 3.4 GHz to 3.8 GHz. Here, a gap spacing A1 of e.g. 45 mm approximately corresponds to 0.39λ for the center frequency of the lowest used resonance frequency range (2600 MHz) and 0.52λ for the center frequency of the next higher used resonance frequency range (3600 MHz). An individual radiator spacing of ≤0.50λ is regarded as ideal spacing for beam-forming applications and beam-steering applications with a wide pivot range of the main lobe, since grating lobes are then avoided. FIG. 20*a* shows an embodiment for resonance frequency ranges from 2.3 GHz to 2.7 GHz and 3.4 GHz to 3.8 GHz. Here too, a gap spacing for A1 of approximately 45 mm is selected. For both embodiments, the selected row spacing A2 can be approximately 70 mm. These embodiments can also cover resonance frequency ranges from 2.5 GHz to 2.7 GHz and 3.4 GHz to 3.6 GHz.

As can be seen in FIGS. 19*a* and 20*a*, the shape of the second dielectric body 2 must be selected according to the application. The objective is a very compact design, in particular very small individual radiator spacing in group antennas, wherein the second dielectric body 2—at an individual radiator spacing of ≤0.72λ, further preferably ≤0.5λ—can be arranged as a dielectric rod radiator and/or dielectric for bundling and/or for resonance frequency expansion.

FIG. 21 shows an antenna array, wherein the second dielectric body 2 is formed as a rod radiator, which represents a sub-shape of radiators with traveling waves. As also shown in FIGS. 20*a*/20*b*, the second dielectric bodies 2 do not make contact, e.g. they are arranged at a distance from each other. As also shown in FIG. 17*e*, the rod radiators have a height H and a thickness or width D, wherein the thickness D corresponds to the diameter of the rod radiator in the case shown here. Here too, resonance frequency ranges from 2.3 GHz to 2.7 GHz and 3.4 GHz to 3.8 GHz and/or from 2.5 GHz to 2.7 GHz and 3.4 GHz to 3.6 GHz can be covered. FIGS. 22*a* and 22*b* show antenna diagrams for the embodiment shown in FIG. 21, wherein the rod radiators in FIG. 22*a* have a height H of 80 mm and a thickness D of 30 mm at 2.6 GHz (left graphic) and at 3.5 GHz (right graphic), and the rod radiators in FIG. 22*b* have a height H of 80 mm and a thickness D of 40 mm at 2.6 GHz (left graphic) and at 3.5 GHz (right graphic). The left graphic in FIGS. 22*a* and/or 22*b* shows the antenna diagrams for 2.6 GHz on port 1 (P1) at usable polarization for the double block with surroundings. The right graphic in FIGS. 22*a* and/or 22*b* shows the antenna diagram for 3.5 GHz and port 1 (P1) at usable polarization for the double block with surroundings.

It is noteworthy that the main lobe and the first side node changes in the 3-D far field diagram depending on the thickness D of the second dielectric body 2. In FIG. 22*a*, the upper frequency has a distorted main lobe and high side lobes at 3.5 GHz, whereas in FIG. 22*b*, the lower frequency has a distorted main lobe and high side lobes at 2.6 GHz. The distorted main lobes and the first side lobes, which lie in a plane alternative to the beam bundling, trace their origins back to the electromagnetic coupling of several second dielectric bodies 2, as shown in FIG. 22 based on the E field (top graphic) in the cross section plane of the radiator array and beam bundling.

The electromagnetic coupling of the second dielectric body 2 can be used in a targeted manner by relying on the thickness D, or generally on the shape of the body 2, to modify the directivity and the half power beam width between two resonance frequency ranges and/or to obtain more similar antenna diagrams in at least two continuous resonance frequency ranges, or in at least two resonance frequency range different and at a distance from each other. In this manner, in particular more similar and/or side-lobe-optimized antenna diagrams can be generated in a plane of the beam bundling or the radiator array—typically the horizontal and/or vertical plane.

The second dielectric body 2 can blend in a group arrangement into a single part and/or overlap with the latter, as e.g. shown in FIGS. 14, 16, and 19. It can further act as a carrier and/or fixing of the first dielectric body 1. Since the second dielectric bodies 2 can blend into a single body, these can be fabricated from a single part and carry and/or integrate the first dielectric bodies 1. The printed circuit board 100 and the printed circuit board substrate 101 can also be made from a single part. In particular, the printed circuit board substrate 101 can also act as a fixing or fastening of the second dielectric body 2.

FIGS. 15*a* and 15*b* show 3-D far field diagrams, that is to say the absolute value of the directivity, of antenna radiators 10 connected together into a circuit (see FIG. 3*b*) and/or coupled, as shown in FIG. 14/14*b*, wherein FIG. 15*a* shows the antenna diagrams of the arrangement without second dielectric body 2, and FIG. 15*b* shows the antenna diagrams of the arrangement with second dielectric body 2. It can be clearly seen in FIG. 15*b* that an alignment of the antenna diagrams is achieved by using the second dielectric body 2.

In an embodiment, the second dielectric body 2 can also be connected with the printed circuit board substrate 101 and/or the printed circuit board 100, e.g. by screw fasteners and/or plug-in connectors and/or adhesive.

Air Slot

As shown in FIGS. 2*a* and 2*b*, the second dielectric body 2 can have an air slot and/or a material recess 21. This facilitates an alignment of the antenna gain and/or the antenna diagram in two different resonance frequency ranges. A very similar antenna gain and/or a similar antenna diagram in two different resonance frequency ranges are viewed as advantageous in particular in 4G/5G transmission methods, for example when a base station assigns two bands to a user, e.g. a person or an object, as is for example the case for the LTE—Carrier Aggregation Technology.

However, two similar antenna diagrams in two different resonance frequency ranges can also be achieved without an air slot and/or material recess 21, e.g. with more complex lens shapes. Since an air slot and/or material recess 21 are not mandatory, and also because there are applications where maximum gain instead of similar gains in two bands is required and/or advantageous, the air slot and/or material recess 21 is an optional attribute. The air slot and/or the material recess facilitates an alignment of the antenna gain and/or antenna diagram in two different resonance frequency ranges.

The advantages of the air slot and/or the material recess 21 without limitation include that the antenna diagrams of the two resonance frequency ranges can be realized with a simple shape of the second dielectric body 2. Material recesses also reduce material losses since the wave attenuation of electromagnetic waves is less in open space as compared to lossy materials, and the first dielectric body 1 can be easily inserted into, or blended together with, the second dielectric body 2.

FIGS. 4*a* to 4*c* show electrical values of an antenna radiator 10 without the second dielectric body 2, and FIGS. 5*a* to 5*c* show corresponding electrical values of an antennae radiator 10 with the second dielectric body 2 and an air slot and/or material recess 21. [ . . . ] show the value of the S-parameters, wherein S1.1 and S2.2 are called return loss (adjustment) and show the resonance frequency range of the antenna. S2.1 and S1.2 are called transmission and show the coupling/decoupling of the two antenna ports.

FIGS. 4*b* and/or 4*c* and 5*b* and/or 5*c* show the amount and the phase of the S-parameters in the Smith diagram. S1.1 and S2.2 are called complex antenna impedance and show the bandwidth and the bandwidth potential of the antenna. FIGS. 4*b* and 5*b* show a frequency range from 2.2 to 2.7 GHz and FIGS. 4*c* and 4*c* show a frequency range from 3.4 to 3.8 GHz. As a general rule, the more compact and centered the graph is about the value 1, the better the alignment, and the more compact the graph is to a circle about 1, the higher the bandwidth potential. As can be seen from the comparison between FIGS. 4 and 5, use of the second dielectric body 2 improves both, the alignment, as well as the bandwidth potential. This can also be seen in FIGS. 6*a* (without a second dielectric body 2) and 6*b* (with second dielectric body 2), again for two different frequencies, 2.6 GHz and 3.5 GHz. The 3-D far field diagram shows the absolute value of directivity. In the 3-D far field diagrams, P1 refers to the excited port, Phi refers to the azimuth angle, and Theta refers to the elevation angle. It can be seen that the alignment of the antenna diagrams exhibits a significant improvement by using the second dielectric body 2.

Figure 7A:
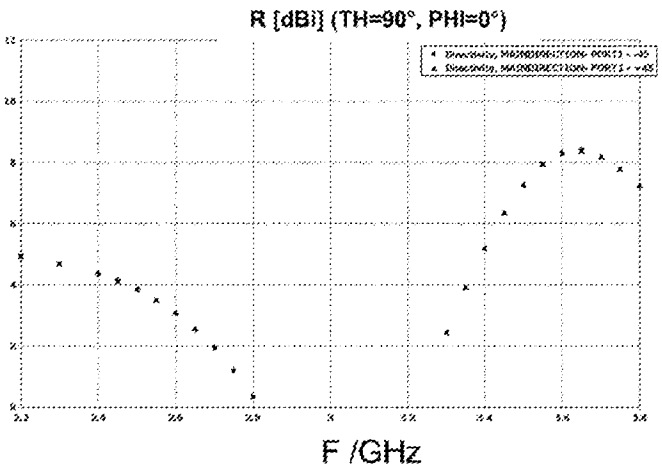
Figure 7B:
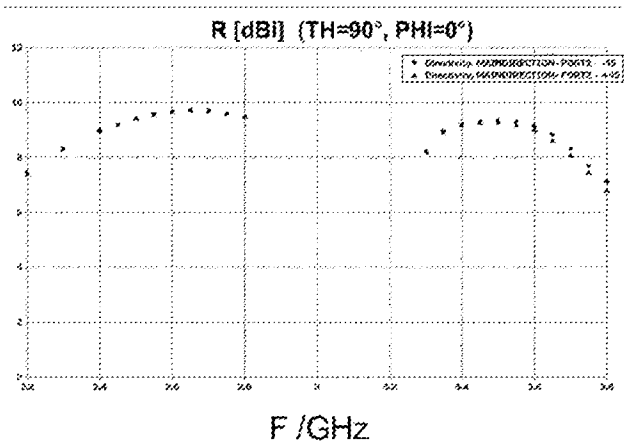
Figure 8A:
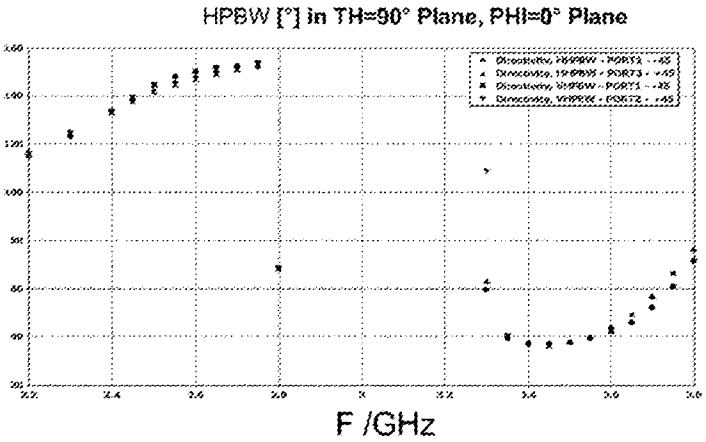
Figure 8B:
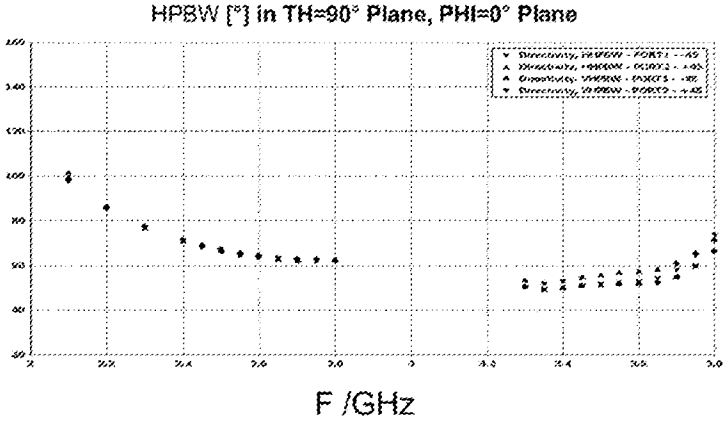

FIGS. 7*a* and 7*b* show electrical values of directivity in the horizontal and vertical antenna diagram cross-section, that is to say the value of the usable polarization ratio (+/−45°) of the directivity in the main radiation direction, again without (FIG. 7*a*) and with (FIG. 7*b*) second dielectric body 2 and air slot and/or material recess 21. FIGS. 8*a* and 8*b* show the corresponding value of the half value beam width, e.g. the angle range for which directivity is reduced by 3 dB, in the horizontal and vertical antenna diagram cross-section, again without (FIG. 8*a*) and with (FIG. 8*b*) second dielectric body 2 and air slot and/or material recess 21. It can again be seen that the alignment of the antenna diagrams exhibits significant improvements by using the second dielectric body 2.

The first dielectric body 1 is preferably excited in all employed resonance frequency ranges by a slot and a cylindrical shape with a hybrid field distribution, HEM11 with directional antenna diagram. The combination of the first and second dielectric body 1, 2 preferably carries the HEM11-Mode, HEM12-Mode, or HEM21-Mode. The HEM12-Mode and HEM21-MODE are of particular of interest for a further, third resonance frequency range. Advantageously, the excited HEM-Modes fall into one of the following frequency ranges F: F(n, f0)=(n+1)*0.5*f0±0.15*(n+1)*0.5*f0, wherein n is a natural number (1, 2, 3, 4, . . . ) and f0 is the center frequency of the lowest preferred resonance frequency range in GHz.

In an advantageous embodiment, the lowest resonance frequency range is excited with the HEM111 Mode and the next higher resonance frequency range with the HEM112 Mode. A cylindrical body shape of the first dielectric body 1 is particularly preferred for an excitement of the HEM Mode with a slot 112 in the printed circuit board 100. Excitement with the HEM11 field distribution (Mode) results in a directional and linearly polarized antenna diagram with high directivity in the main beam direction, e.g. orthogonal to the E and H field component.

In an embodiment, the first dielectric body 1 has a cylindrical shape and is preferably excited in all resonance frequency ranges with a hybrid field distribution, the HEM11 field distribution (Mode) and/or at least two of the used resonance frequency ranges are excited with an HEM11 Mode. Particularly preferably, the lowest resonance frequency range is excited with the HEM111 Mode and the next higher resonance frequency range is excited with the HEM112 Mode. The last index n in the HEM11n nomenclature in the present case indicates the number of half wave lengths and/or the number of E field half arcs in the plane orthogonal to the H field plane.

Figure 9A:
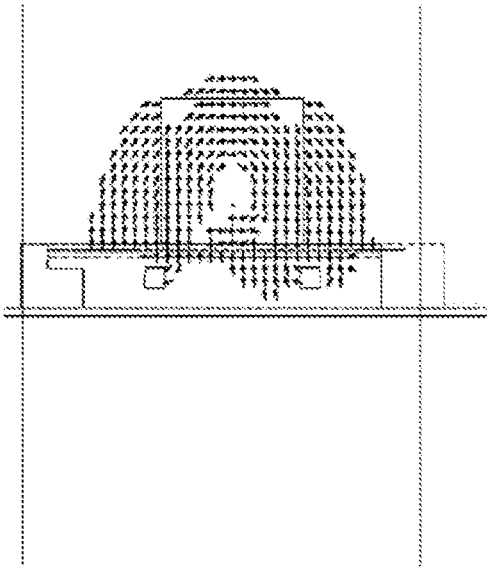
Figure 10A:
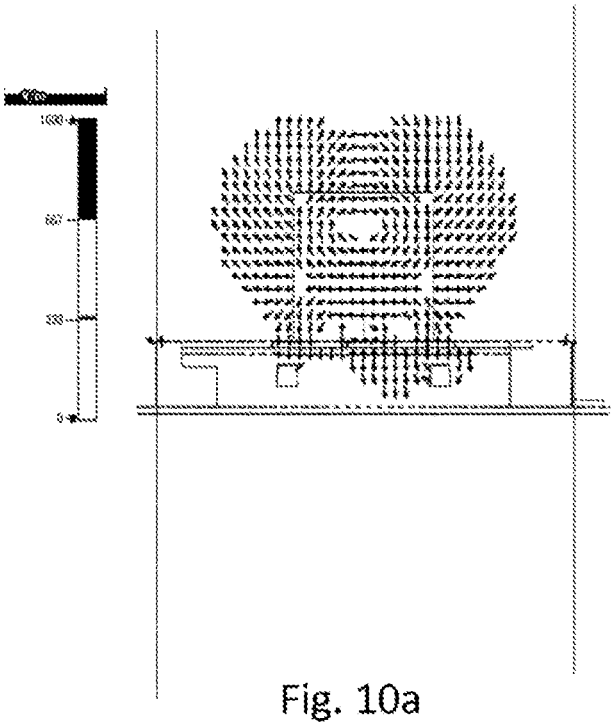
Figure 9B:
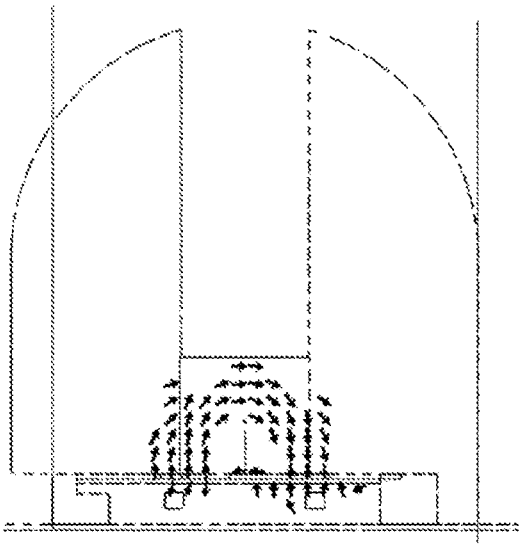
Figure 10B:
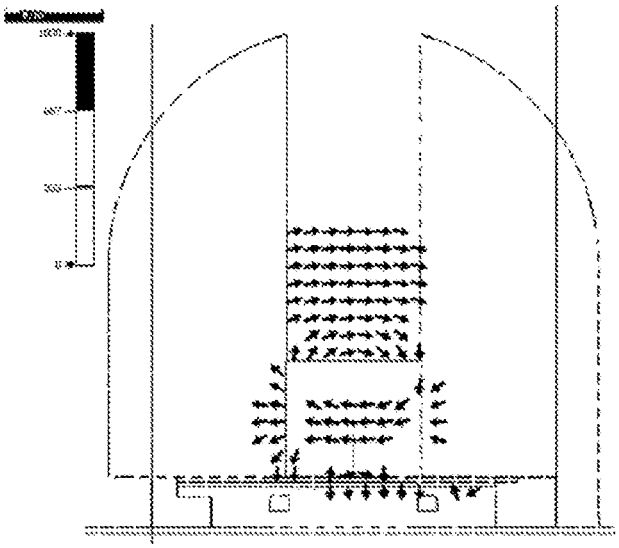

FIGS. 9*a* and 9*b* show the E field in the cross-section plane of the excited usable polarization with the HEM111 Mode (FIG. 9*b*) and HEM111 Mode (FIG. 9*a*) (at 2.6 GHz and 0° phase) without (FIG. 9*a*) and with (FIG. 9*b*) second dielectric body 2 and air slot and/or material recess 21, and FIGS. 10*a* and 10*b* show the E field in the cross-section plane of the excited usable polarization with the HEM112/HEM113 Mode (FIG. 10*b*) and HEM113 Mode (FIG. 10*a*) (at 3.5 GHz and 0° phase) without (FIG. 10*a*) and with (FIG. 10*b*) second dielectric body 2 and air slot and/or material recess 21.

Figure 11A:
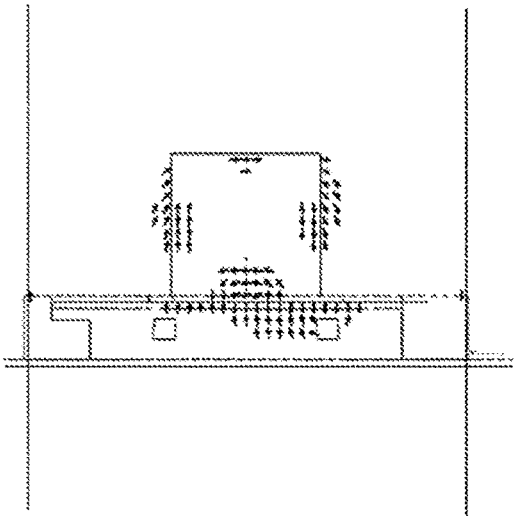
Figure 12A:
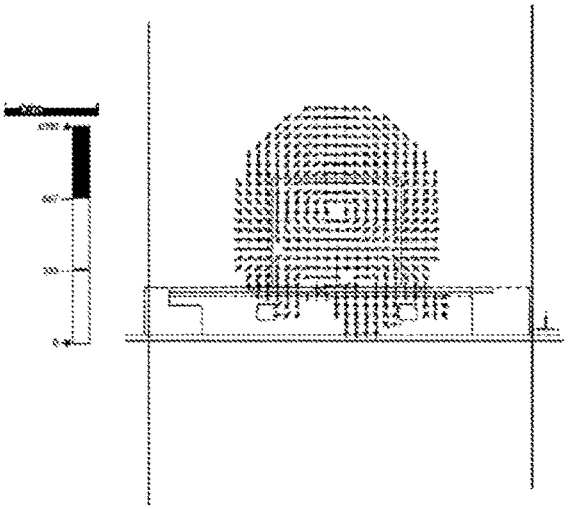
Figure 11B:
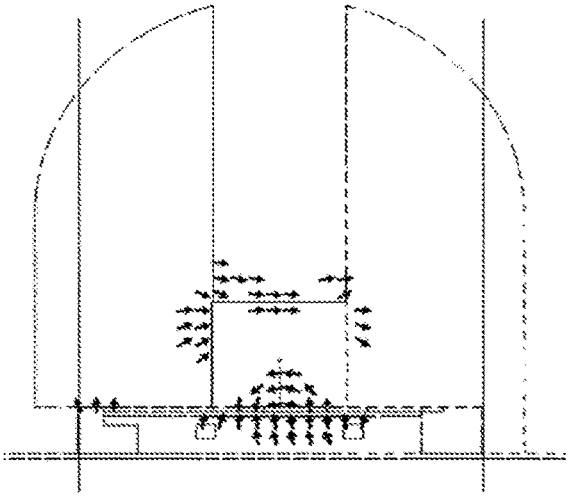
Figure 12B:
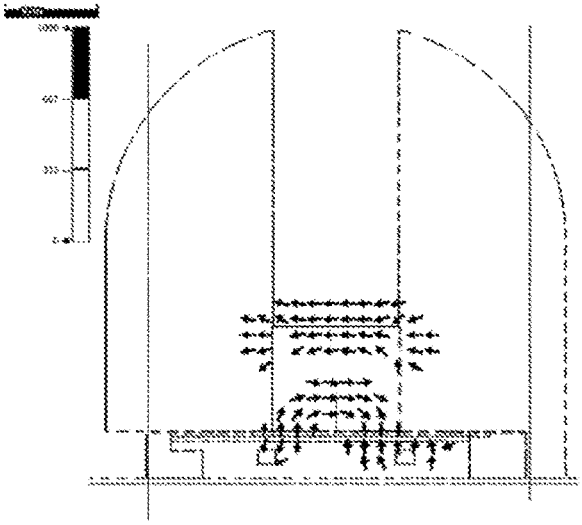

FIGS. 11*a* and 11*b* show the E field in the cross-section plane of the excited usable polarization with the HEM111 Mode (FIG. 11*b*) and HEM111 Mode (FIG. 11*a*) (at 2.6 GHz and 90° phase) without (FIG. 11*a*) and with (FIG. 11*b*) second dielectric body 2 and air slot and/or material recess 21, and FIGS. 12*a* and 12*b* show the E field in the cross-section plane of the excited usable polarization with the HEM112/HEM113 Mode (FIG. 12*b*) and HEM113 Mode (FIG. 12*a*) (at 3.5 GHz and 90° phase) without (FIG. 12*a*) and with (FIG. 12*b*) second dielectric body 2 and air slot and/or material recess 21.

It can be seen here that a significantly more defined, e.g. less scattered E field results when the second dielectric body 2 is used. In particular for the upper frequency, the E field is concentrated in the air slot. It can be further seen that use of the second dielectric body 2 changes the field distribution in the first dielectric body 1, in particular in the lower resonance frequency range. With the assistance of the second dielectric body 2, the first dielectric body 1 acts electrically smaller, in particular in the lower resonance frequency range.

Figure 13:
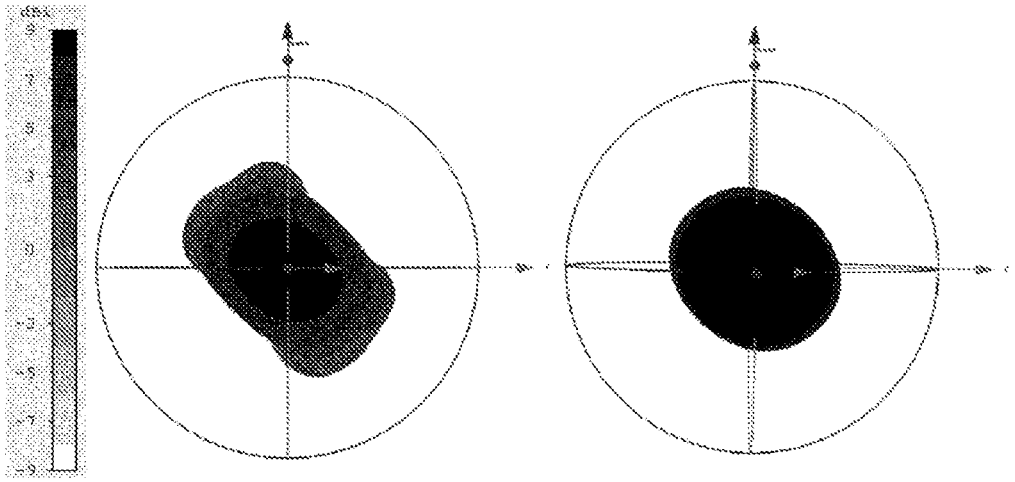
Figure 13:
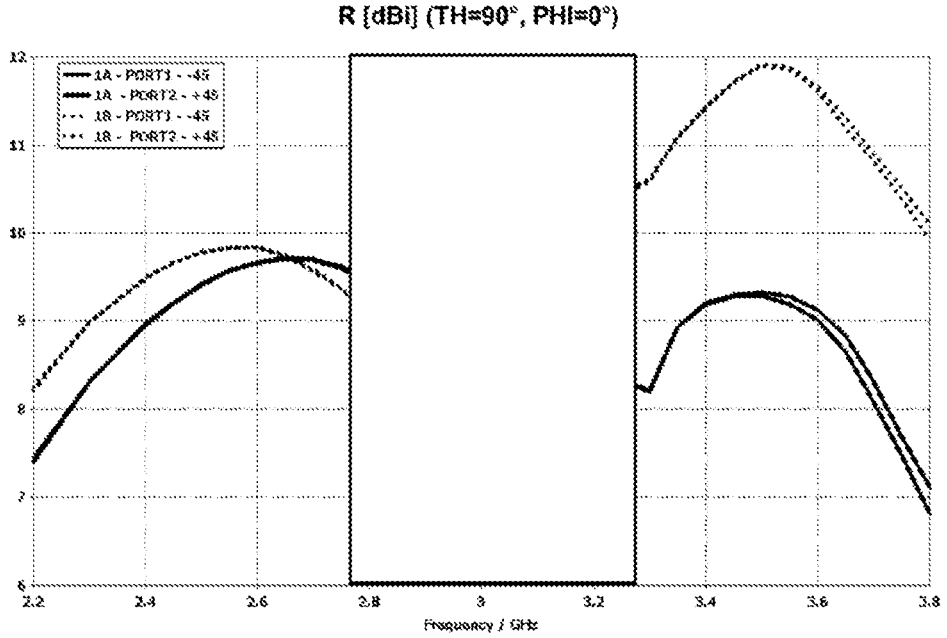

FIG. 13 shows electrical values, specifically in the 3-D far field at 3.6 GHz and the directional characteristic R of an antenna device 10 according to the invention with an antenna radiator 10 with air slot 21 (top/bottom left) and without air slot 21 (top/bottom right), as e.g. shown in FIGS. 1*a* and/or 2*a*.

The electrical values allow the conclusion to be drawn that first dielectric body 1 with high relative permittivity εr1 generates the two resonance frequency ranges, and the second dielectric body 2 with low relative permittivity εr2 increases the bandwidth of the two resonance frequency ranges and adjusts the directivity, that is to say the far field diagrams, of the lower resonance frequency range to the upper resonance frequency range. Depending on the shape and size of the second dielectric body 2, various bandwidths and directivities can be realized, wherein the higher the bandwidth and/or directivity the smaller the filter effect and/or the individual radiator dimensions and vice-versa. This enables the modular concept by merely substituting and/or modifying the second dielectric body 2 to obtain certain bandwidths and directivities.

The present discussions of the antenna device allow compact group antennas and/antenna arrays, e.g. antenna arrays with small gap spacing, to be realized that at the same time have a high-bandwidth and very good directivity.

REFERENCE SYMBOL LIST

10 Antenna Radiator
1 and/or 2 First and/or Second Dielectric Body
21 Air Slot
22 Mechanical Dead Stop
100 Printed Circuit Board
101 Substrate
102 Coupling Window
103 Micro-Strip Feed Technology
111 Via Area
112 Slot
HPBW Half Power Bandwidth or 3 dB Opening Angle
R Directivity

The invention claimed is:

1. Antenna device, having a printed circuit board; and at least one antenna radiator arranged on the printed circuit board and excitable by the printed circuit board or by a coupling window arranged thereupon, which the radiator is designed in such a manner that the radiator comprises at least two polarizations, which are orthogonal to each other, and at least two resonance frequency ranges which are continuous or different to one another and at an interval from one another, where the antenna radiator comprises:

at least one first dielectric body mounted on the printed circuit board and designed as a resonator, having a first relative permittivity (εr1); and at least one second dielectric body designed as an integrated lens or as a radiator with travelling waves and/or as a second dielectric body comprised as a dielectric rod radiator, having a second relative permittivity (εr2), wherein the first relative permittivity (εr1) is greater than the second relative permittivity and wherein the second dielectric body is formed in such a manner that it the second dielectric body is arranged over the at least one first dielectric body in such a manner that the second dielectric body bundles or scatters the electrical field in a plane orthogonal to the main beam direction in at least one of the resonance frequency ranges.

2. The antenna device according to claim 1, wherein the following applies for the first relative permittivity (εr1) and for the second permittivity (εr2):

|εr1−εr2|≥10 and wherein the following applies for the first relative permittivity (εr1):εr1≥12 and wherein the following applies for the second relative permittivity (εr2):2≤εr2≤5.

3. The antenna device according to claim 1, wherein the maximum thickness (D) and height (H) of the second dielectric body are governed by the following relationship to the wave length (λ) of the center frequency of the lowest resonance frequency range of the antenna and the effective relative permittivity (εr2) of the second dielectric body (2):

$$0.5*\frac{\lambda}{\sqrt{\pi(\varepsilon_{r2}-1)}} \le H \le 2.5*\frac{\lambda}{\sqrt{\pi(\varepsilon_{r2}-1)}} \text{ and/or}$$

$$0.5*\frac{\lambda}{\sqrt{\pi(\varepsilon_{r2}-1)}} \le D \le 2.5*\frac{\lambda}{\sqrt{\pi(\varepsilon_{r2}-1)}}.$$

4. The antenna device according to claim 1, wherein the maximum thickness D and the height H of the second dielectric body are governed by the following advantageous relationship between the maximum thickness (D) and the height (H):

$D=(1.0\pm0.5)\times H$, if designed as a lens or radiator, or $D=(0.5\pm0.25)\times H$, if designed as a radiator.

5. The antenna device according to claim 1, wherein the excitation of the first dielectric body occurs symmetrically in relation to the center point of the cross-section of the first dielectric body.

6. The antenna device according to claim 1, wherein the printed circuit board has a coupling window, and wherein the first dielectric body covers at least 75%.

7. The antenna device according to claim 1, wherein the second dielectric body has at least one air slot continuous from a top side of the second dielectric body to a bottom side thereof, with an air slot being formed and arranged such that the air slot accepts the first dielectric body therein.

8. The antenna device according to claim 7, wherein a mechanical dead stop is arranged in the air slot such that the first dielectric body is fixed after assembly between the printed circuit board and the top side of the air slot.

9. The antenna device according to claim 7, wherein a third dielectric body is incorporated in the air slot and firmed to modify the antenna diagram.

10. The antenna device according to claim 1, wherein the second dielectric body is shaped such that at least one resonance frequency range experiences an enlargement and/or increase in directivity and/or an enlargement of the half power beam width, or at least two of the resonance frequency ranges experience an enlargement and/or increase and/or alignment of directivity and/or the antenna diagrams, and/or the lowest resonance frequency range experiences a higher increase of directivity and/or antenna gain in the main beam direction compared to an upper resonance frequency range; and/or the antenna diagram of the lowest resonance frequency range has a higher similarity with the antenna diagram of the at least one upper resonance frequency range.

11. The antenna device according to claim 1, wherein the second dielectric body over at least 75% of a height (H) has the shape of a cuboid and/or cylinder and/or cone and/or truncated cone.

12. The antenna device according to claim 1, wherein the first dielectric body has a cylinder shape and in combination with the second dielectric body is excited in at least two preferred resonance frequency ranges with an HEM11 Mode and/or HEM12 Mode and/or HEM21 Mode, and/or all excited HEM Modes fall into any of the following frequency ranges:

$$F(n,f_0)=(n+1)*0.5*f_0\pm0.15*(n+1)*0.5*f_0,$$

wherein n is a natural number and $f_0$ is the center frequency of the lowest preferred resonance frequency range in GHz.

13. The antenna device according to claim 1, wherein the first dielectric body has a cylinder shape and at least two of the employed resonance frequency ranges are excited with an HEM11 Mode, wherein the lowest resonance frequency range is excited with the HEM111 Mode and the next higher resonance frequency range is excited with the HEM112 Mode.

14. Antenna array, formed of at least one antenna device according to claim 1, arranged in a specified spacing (A1; A2) in rose and/or columns, wherein the spacing (A1; A2) between the rose and/or columns is ≤0.75 wavelengths of the center frequency of the lowest employed resonance frequency range.

15. The antenna array according to claim 14, wherein respectively two antenna radiators are connected together as a circuit into a double block such that a horizontal or vertical beam bundling is achieved, and the beam bundling occurs in the correspondingly opposite direction primarily by the second dielectric body arranged above the first dielectric bodies.

16. The antenna array according to claim 15, wherein several second dielectric bodies are physically connected or electromagnetically coupled to each other.

17. The antenna array according to claim 16, wherein the second dielectric bodies are connected into a circuit or coupled to each other such that in the plane of the circuit connection of the radiators or in the plane of the beam building and/or the plane of the main beam pivot, in particular in the vertical and/or horizontal plane at least one resonance frequency range experiences an enlargement and/or increase of directivity and/or an enlargement of the half power beam width; or at least two of the resonance frequency ranges experience an enlargement and/or increase and/or alignment of directivity and/or the antenna diagrams, and/or the antenna diagram of the lowest resonance frequency range has a higher similarity with the antenna diagram of the at least one upper resonance frequency range; and/or the antenna diagrams of at least one resonance frequency range have optimized side lobes.

18. The antenna array according to claim 17, wherein each of the second dielectric bodies carries its associated first dielectric body and/or is connected with the printed circuit board.

19. An antenna device, comprising:

a printed circuit board; and at least one antenna radiator arranged on the printed circuit board and excitable by the printed circuit board or by a coupling window arranged thereupon, which the radiator is configured to generate at least two polarizations that are orthogonal to each other and at least two resonance frequency ranges, wherein the antenna radiator comprises:

at least one first dielectric body mounted on the printed circuit board and designed as a resonator, having a first relative permittivity (εr1);

at least one second dielectric body having a second relative permittivity (εr2) lower than the first relative permittivity (εr1) and configured as an integrated lens for broadening a beamwidth of a radiation pattern of the antenna device.

20. The antenna device of claim 19, wherein the maximum thickness (D) of the second dielectric body re governed by the following relationship to the wave length (λ) of the center frequency of the lowest resonance frequency range of the antenna and the effective relative permittivity (εr2) of the second dielectric body (2):

$$0.5 * \frac{\lambda}{\sqrt{\pi(\varepsilon_{r2} - 1)}} \leq D \leq 2.5 * \frac{\lambda}{\sqrt{\pi(\varepsilon_{r2} - 1)}}.$$

21. The antenna device of claim 19, wherein the maximum thickness D and the height H of the second dielectric body are related by:

$$D=(1.0)\pm 0.25)\times H.$$

22. The antenna device of claim 19, wherein the maximum thickness D and the height H of the second dielectric body are related by:

$$D=(0.5)\pm 0.25)\times H.$$

23. The antenna device of claim 19, wherein the maximum Height (H) of the second dielectric body re governed by the following relationship to the wave length (λ) of the center frequency of the lowest resonance frequency range of the antenna and the effective relative permittivity (εr2) of the second dielectric body (2):

$$0.5 * \frac{\lambda}{\sqrt{\pi(\varepsilon_{r2} - 1)}} \leq H \leq 2.5 * \frac{\lambda}{\sqrt{\pi(\varepsilon_{r2} - 1)}}.$$

* * * * *